US005787327A

United States Patent [19]

Matsushita et al.

[11] Patent Number: 5,787,327

[45] Date of Patent: Jul. 28, 1998

[54] CHARGING DEVICE FOR IMAGE FORMING APPARATUS

[75] Inventors: Kouji Matsushita; Yasuhiro Nakagami, both of Toyokawa, Japan

[73] Assignee: Minolta Co., Ltd., Osaka, Japan

[21] Appl. No.: 671,879

[22] Filed: Jun. 28, 1996

[30] Foreign Application Priority Data

Jun. 30, 1995 [JP] Japan ..... 7-166596
May 14, 1996 [JP] Japan ..... 8-119221

[51] Int. Cl.[6] ..... G03G 15/22; B41J 2/39

[52] U.S. Cl. ..... 399/130; 347/141; 347/147; 347/148; 347/149

[58] Field of Search ..... 355/210, 219; 347/141, 147–149, 152; 361/214, 225, 230; 399/168, 130, 144, 148, 174

[56] References Cited

U.S. PATENT DOCUMENTS

| | | | |
|---|---|---|---|
| 4,233,611 | 11/1980 | Nakano et al. | 347/150 |
| 4,356,501 | 10/1982 | Ronen | 347/148 |
| 4,390,887 | 6/1983 | Chynoweth et al. | 347/147 |
| 4,546,364 | 10/1985 | Todoh | 347/147 |
| 5,278,614 | 1/1994 | Ikegawa et al. | 355/219 |
| 5,321,472 | 6/1994 | Adachi et al. | 355/219 |
| 5,323,215 | 6/1994 | Ohtaka et al. | 355/219 X |
| 5,353,101 | 10/1994 | Adachi et al. | 355/219 |
| 5,384,626 | 1/1995 | Kugoh et al. | 355/219 |
| 5,402,213 | 3/1995 | Ikegawa et al. | 355/219 |

FOREIGN PATENT DOCUMENTS

| | | |
|---|---|---|
| 59-87180 | 5/1984 | Japan . |
| 60-49962 | 3/1985 | Japan . |

*Primary Examiner*—Matthew S. Smith
*Attorney, Agent, or Firm*—McDermott, Will & Emery

[57] ABSTRACT

This invention relates to the charging member portion of an image forming apparatus. A plurality of charging members are disclosed that maintain a uniform spacing between a charge-receiving member and the discharging portion of the charging members' electrodes despite surface irregularities and surface waviness on the charge-receiving member. One charging member is in the form of a flexible sheet provided with ventilation holes in a non-contacting portion thereof, permitting the air produced by the rotation of the charge-receiving member to escape through the holes to suppress the lifting of the charging member. Pressure fins can be added to the charging member on the downstream of the ventilation holes for further suppressing any lifting. Another charging member includes a semiconductive member or a electret member on at least the surface of the charging member on the side opposite the charge-receiving member. This permits the charging member to be electrostatically attracted to the charge-receiving member.

43 Claims, 20 Drawing Sheets

CHARGING DEVICE FOR IMAGE FORMING APPARATUS

BACKGROUND OF THE INVENTION

1. Field of the Invention

The present invention relates broadly to an improved charging device for charging a charge-receiving member.

The present invention is directed more specifically to an improved charging device for maintaining an even distance between the charging device and the charge receiving member.

2. Description of the Related Art

Image forming apparatuses have been provided with various types of charging devices. For example, a charging device in the form of an electrostatic recording head comprising a wide printed circuit board formed by a multiple-styli head to charge a charge receiving member (recording member) was disclosed in Japanese Unexamined Laid-Open Patent No. SHO 60-49962. In this electrostatic recording head, the surface of the printed circuit board, on the side opposite the charge-receiving member, is shaved in the width direction to form a thin region. A reinforcing member having a highly flat surface is provided at the aforesaid thin region. Waviness in the printed circuit board is corrected by the aforesaid reinforcing member.

Further, Japanese Unexamined Laid-Open Patent No. SHO 59-87180 discloses a recording head provided with a spacer at the top of said electrostatic recording head, which makes contact with a recording member through said spacer. In this electrostatic recording head, a predetermined small spacing is maintained between the top of the recording head and the recording member by means of the spacer.

In another example, U.S. Pat. No. 4,233,611 discloses a plate-like charging device having a parallel arrangement of flexible wire electrodes protected by a flexible insulation member. In this charging device, the entirety of the flexible insulation member maintains an oblique pressure on the charge-receiving member, to maintain a spacing between the wire electrodes and charge-receiving member while a part of the flexible insulation member is in contact with said charge-receiving member (recording member).

Lastly, U.S. Pat. No. 5,278,614 discloses a charging film that protects an electrically insulated layer at a region of contact with a charge-receiving member.

These prior art charging devices are ineffective for maintaining an even distance between the charging device and the charge receiving member.

Specifically, in the conventional charging devices disclosed in Japanese Unexamined Laid-Open Patent Nos. SHO 60-49962 and SHO 59-87180, surface irregularities and surface waviness in the charge-receiving member cannot be adequately compensated, because of the relative hardness of the reinforcing member, printed circuit board, electrostatic print head, and spacer. Accordingly, the distance separating the electrodes and the charge-receiving member is not sufficiently uniform, leading to print irregularities, which are caused by the irregular charging of the surface of the charge-receiving member.

On the other hand, in the charging device disclosed in U.S. Pat. No. 4,233,611, the entirety of the flexible insulating member is obliquely pressed against a charge-receiving member so as to maintain a constant spacing between the wire electrodes and charge-receiving member. At the same time, a part of the flexible insulation member makes contact with the charge-receiving member, with the flexible insulation member and wire electrodes conforming somewhat to the surface irregularities and surface waviness of the charge-receiving member. As a result, this charging device attains a more uniform distance between the electrodes and charge-receiving member compared to the charging devices disclosed in Japanese Unexamined Laid-Open Patent Nos. SHO 60-49962 and SHO 59-87180. However, the charging device disclosed in U.S. Pat. No. 4,233,611, as in the aforesaid charging devices, cannot adequately conform to surface irregularities and surface waviness of the charge-receiving member when the flexible insulation member is thick or hard. But, if the flexible insulation member is made thin and pliable, so as to conform to the surface irregularities and surface waviness of the charge-receiving member, the flexible wire electrodes cannot be properly positioned relative to the recording member. As a result, a thin flexible insulation member cannot adequately conform to the surface irregularities and surface waviness of the charge-receiving member. Furthermore, the flexible insulation member disclosed in U.S. Pat. No. 4,233,611 is easily pushed upward by the air pressure arising from the movement and rotation of the charge-receiving member, such that the distance separating the charge-receiving member and the flexible electrodes becomes uneven and gives rise to irregular electric potentials, thereby resulting in printing irregularities.

Moreover, U.S. Pat. No. 4,233,611 does not compensate for the effects of the air pressure by, for example, applying a force to the charging member to negate any lifting action. As a result, the discharging leading edge of the flexible electrodes oscillates relative to the charge-receiving member via the combined applied forces because a force is being added, which acts in the direction in which the flexible insulation member extends due to the friction force in the region of contact produced by the rotation and movement of the charge-receiving member. Thus, discharge synchronicity lags occur in the rotation and movement directions of the charge-receiving member, which causes printing irregularities.

The charging film, disclosed in U.S. Pat. No. 5,278,614, conforms to the surface irregularities and surface waviness of the charge-receiving member, similarly to the charging device disclosed in U.S. Pat. No. 4,233,611. However, U.S. Pat. No. 5,278,614 does not address the disadvantages caused by the lifting of the charging film and discharge synchronicity lags.

None of the conventional devices described above provide the advantages of a charging device for image forming apparatuses having a thin flexible insulating member that conforms to surface irregularities and surface waviness to maintain a distance between electrodes on the insulating member and a charge receiving member.

SUMMARY OF THE INVENTION

An object of the present invention is to provide a charging device for image forming apparatuses, which is capable of producing excellent images by suppressing the occurrence of nonuniform spacing between the charge-receiving member and discharging portion of the charging member's electrode due to surface irregularities and surface waviness of a charge-receiving member, suppressing discharge synchronicity lags from various parts of the charging member, and suppressing charging irregularities such as inadequate charging and the like.

The present invention provides three types of charging devices for image forming apparatuses, described below in greater detail, to eliminate the previously described disadvantages.

(1) One charging device is provided with a flexible sheet-like charging member for image forming apparatuses, wherein the flexible sheet-like charging member has a portion of its surface for contacting a charge-receiving member and charging the charge-receiving member, and wherein the flexible sheet-like charging member has ventilation holes or apertures in a further portion of its surface, which further portion is not intended to make contact with the charge-receiving member.

In this charging device, the aforesaid ventilation holes allow air to escape so as to suppress oscillation in the direction of travel of the surface of the charge-receiving member. In addition, the ventilation holes suppress any lifting of the charging member due to airflow generated by the rotation and movement of said charge-receiving member.

According to this charging device, the flexible sheet-like charging member, which is normally supported, makes contact with the surface of the charge-receiving member and charges the charge-receiving member while a part of the surface of said charging member is in a state of contact with the charge-receiving member.

Although the airflow produced by the movement and rotation of the charge-receiving member tends to lift the charging member as in the conventional art, such lifting of the charging member according to the present invention is suppressed because air is allowed to escape through the ventilation holes provided in the charging member of the charging device. Since the charging member is a flexible sheet-like member that includes ventilation holes for suppressing the aforesaid lifting, the charging member conforms closely with the charge-receiving member regardless the surface irregularities and surface waviness of the charge-receiving member. As a result, a uniform discharge gap is formed between the charge-receiving member and the discharge portion of the electrode in the charging member. Also, the airflow on the charging member produced by the escaping air through the ventilation holes provides the advantage of suppressing oscillation in the direction of movement of the surface of the charging member, and further suppressing discharge synchronicity lags from various parts of the charging member. As pointed out in greater detail below, the use of the ventilation holes provide the important advantages of excellent charging attained by suppressing charging irregularities, and ultimately producing excellent images thereby.

(2) Another charging device is also provided having a flexible sheet-like charging member for use in image forming apparatuses for charging a charge-receiving member, wherein the flexible sheet-like charging member has a portion of its surface for contacting said charge-receiving member, and wherein the flexible sheet-like charging member has a semiconductive member or a electret member on at least the surface of the charging member on the side opposite the charge-receiving member.

In this charging device, the flexible sheet-like charging member is electrostatically attracted to the charge-receiving member because the aforesaid semiconductive member and electret member suppresses the oscillation of the charging member in the direction of travel of the surface of the charge-receiving member and suppresses the lifting of the charging member attributable to the airflow generated by the rotation and movement of the charge-receiving member.

In this charging device, the flexible sheet-like charging member, which is normally supported, makes contact with the surface of the charge-receiving member and charges the charge-receiving member while a part of the surface of said charging member is in a state of contact with the charge-receiving member.

Although the airflow generated by the movement and rotation of the charge-receiving member tends to lift the charging member as in the conventional art, such lifting of the charging member is suppressed because an electrostatic attractive force is generated between the charge-receiving member and the charging member via charge imparted to the semiconductive member or the action of the electret member provided on at least the surface of the charging member on the side opposite the charge-receiving member, thereby achieving stable contact of the charging member with the charge-receiving member. As a result, uniform contact is made between the charging member and charge-receiving member due to the flexible nature of the charging member regardless of the aforesaid generation of airflow and regardless of surface irregularities and surface waviness of the charge-receiving member. Also, a uniform discharge gap is formed between the charge-receiving member and the discharge portion of the electrode on the charging member. Further, discharge synchronicity lags from various parts of the charging member are suppressed by suppressing the oscillation of the charging member in the direction of movement of the surface of the charge-receiving member. As pointed out in greater detail below, the use of a semiconductive member or an electret member on at least the surface of the charging member on the side opposite the charge-receiving member provides the important advantages of suppressing irregular charging, resulting in the achievement of excellent charging and ultimately providing excellent images.

When at least a portion of the surface of the charging member on the side opposite the side in contact with the charge-receiving member is formed by a semiconducting member, a means may be provided to supply a voltage to said semiconductive member.

(3) A further charging device in accordance with the present invention flows from the combination of the constructions of the charging devices (1) and (2), broadly described above.

This charging device combines the structures of the previously described charging devices (1) and (2) and provides the achievement of excellent charging by suppressing insufficient charging and charge irregularities with greater reliability, and ultimately producing excellent images thereby.

In the charging device having a charging member provided with ventilation holes of the present invention, the charging member may be further provided with fins on the downstream side from said ventilation holes in the direction of movement of the surface of the charge-receiving member for receiving the pressure of the airflow passing through said ventilation holes. When the aforesaid fins are provided, they receive the pressure of the airflow passing through the ventilation holes such that the charging member is pressed toward the charge-receiving member, thereby achieving greater uniformity in the discharge gap formed between the charge-receiving member and the various parts of the charging member, and also, achieving greater suppression of discharge synchronicity lags.

When at least a portion of the surface of the charging member on the side opposite the side in contact with the charge-receiving member is formed by a semiconducting member, a means may be provided to supply a voltage to said semiconductive member.

In the charging device of the present invention wherein at least a portion of the surface of the charging member on the side opposite the side in contact with the charge-receiving member is formed by a semiconducting member or an electret member, the material of the semiconductive member may be, but is not limited to, conductive materials mixed with synthetic resins such as fluororesin (e.g., ethylene tetrafluoride resin), polyimide, and polyester and the like. Examples of usable methods for forming the charging member include application of a fluid semiconductive material by spattering and like means. However, the present invention is not limited to these methods. Since the semiconductive member is the part that contacts and rubs against the charge-receiving member, it is desirable that a wear resistant material be used. It is further desirable that such material have a small friction coefficient relative to the charge-receiving member from the perspective of the torque produced on the charge-receiving member. Furthermore, residual materials, such as toner used for developing an image, can accumulate on the charging device even though a cleaning device is provided for the charge-receiving member. Therefore, it is desirable that the material used have release characteristics relative to the residual materials, such as toner, used for developing so as to prevent fusion of said toner to the charging member. A resistance value in the range of about $10^1$ to about $10^8$ Ω·cm is suitable for the semiconductive member.

Materials useful for forming the electret member include suitably processed sheet-like electret materials such as PFA (perfluoroalkoxy), FEP (fluoro-ethylenepropylene) and the like. The process for forming the electret member can include a process wherein a suitable electret material is maintained at about 150° C. to about 200° C. while the surface of the electret material is subjected to corona irradiation or electron beam irradiation. Then, the temperature is gradually reduced during the irradiation period until room temperature is reached and irradiation is terminated. A semi-permanent charging member having different polarities on bilateral surfaces of the electret material can be obtained by the aforesaid process.

Among the charging devices of the present invention, is a charging device wherein at least a portion of the surface of the charging member on the side in contact with the charge-receiving member is formed by a semiconducting member and a means is provided for applying a voltage to said semiconductive member. The voltage applied to the semiconductive member by the voltage applying means can be a voltage that does not charge the charge-receiving member to a predetermined potential. Specifically, the difference in the potential of the charge-receiving member and the aforesaid voltage can be an absolute value of, for example, less than 550 V. When such a voltage is used, the residual potential on the surface of the charge-receiving member is maintained prior to arriving at the charging member without applying a load on the charge-receiving member. The charge-receiving member is charged, however, when the voltage exceeds 550 V. A particular voltage applying means that can be used is one that supplies a voltage polarity during image formation that is opposite to the polarity applied during non-image formation, i.e., an alternating current (AC), so as to clean the semiconductive member.

In all of the previously described charging devices (1), (2), and (3), the flexible sheet-like charging member is entirely sheet-like, and therefore typically comprises a flexible electrode provided on one side of a flexible sheet-like electrically insulated material (hereinafter referred to as "flexible insulation material"). When the charging member is provided with a flexible electrode on one side of a flexible insulation material as described above, a part of the flexible insulation member surface on the side opposite that provided with the electrode (normally the surface of the free end on the charge-receiving member side) makes contact with the charge-receiving member, so as to form a discharge gap between the charge-receiving member and the flexible electrode, and charges the charge-receiving member by a discharge from said flexible electrode (normally the tip of the electrode).

When a flexible electrode is provided on one side of the flexible insulation member, this flexible electrode can be a needle-like, wire like, or band-like flexible electrode or combinations thereof (hereinafter referred to as "flexible wire electrode"), or a continuous film-like flexible electrode.

Any of the aforesaid flexible electrodes may be protected by a flexible, electrically insulated, sheet-like, film-like, or membrane-like member or material.

These flexible electrodes can be formed in many alternate ways, such as by adhering a preformed electrode to a flexible insulation member, or by sandwiching a preformed electrode between a flexible insulation member and said electrode protective member or material using a film formation process or an etching process on a photo registration pattern of said film by vacuum deposition, spattering deposition, and the like on the flexible insulation member.

Examples of materials useful for the aforesaid member or material protecting the electrode and flexible insulation member provided on one side of said flexible electrode include synthetic resins such as fluororesins (ethylene tetrafluoride resin and the like), polyimide, polyester and the like, synthetic rubbers such as urethane rubber and the like, and suitable combinations thereof. It is desirable that at least the portion of the flexible insulation member, which makes rubbing contact with the charge-receiving member be formed of a wear resistant material. It is further desirable that such material have a small friction coefficient relative to the charge-receiving member.

Although the thickness of the portion of the flexible insulation member (normally the tip of said member) overlaying the discharge portion of the flexible electrode (normally the tip of said electrode) depends on the material and Youngls modulus of the flexible insulation member, a thickness of about 5 μm to about 1,000 μm is desirable, and a thickness of about 5 μm to about 200 μm is preferable to adequately respond to the surface irregularities and surface waviness of the charge-receiving member.

The flexible electrode can be typically made with an electrically conductive material such as, for example, conductive metals such as nickel, chrome, copper, gold, platinum, tungsten, aluminum, indium, titanium and the like, or combinations of one or more conductive materials such as ITO, carbon and the like.

Since there is concern of soiling and corrosion of the electrode by products generated by the discharge such as ozone, nitrogen oxides and the like, it is desirable that at least the part of the surface of the flexible electrode that discharges (normally the tip) be covered by an inorganic thin layer of metal oxides, diamond-like carbon layer and the like to prevent the aforesaid soiling and to achieve stable discharges over a long period of use. Since both the electrode and the sheet-like insulation member provided on said electrode have flexibility, it is desirable that the covering be within a range that is not susceptible to cracking.

At least the portion of the flexible electrode that discharges (normally the tip of the electrode) can have an electrical resistance value in the range of about $10^1$ Ω·cm to about $10^8$ Ω·cm to prevent discharges between adjacent electrodes of the previously mentioned flexible wire electrodes and to obtain a stable discharge by preventing leaks between the electrode and charge-receiving member during high humidity conditions. This can be achieved by covering at least the discharging portion of the electrode with a high resistance material (e.g., carbon containing organic material) or by forming the portion of a semiconductive material to increase the external impedance such that excess current does not flow between the electrode and the charge-receiving member, and to increase the impedance between electrodes to prevent discharging between the electrodes. An increased electrical resistance prevents an excessive drive voltage, and eliminates discharge differences arising from differences in the thickness and length of this portion of the electrode.

When the aforesaid flexible wire electrode is used as the electrode, it is desirable that the width of the electrode be within a range of several micrometers to about 100 μm. The distance between adjacent electrodes must be determined, with consideration given to resolution and intra-electrode leakage, and it is desirable that said distance be within a range of about 30 μm to about 100 μm.

In the charging device provided with a charging member having ventilation holes among the previously mentioned charging devices of the present invention, the charging member is provided with a flexible electrode on one side of a flexible insulation member. When the electrode is a flexible wire electrode, the ventilation holes are formed in the portion which is not provided with said wire electrode.

As pointed out above and as pointed out in greater detail below the present invention provide important advantages. In particular, the present invention is drawn to various charging devices for image forming apparatuses, which are capable of producing excellent images by suppressing the occurrence of nonuniform spacing between the charge-receiving member and discharging portion of the charging members' electrode due to surface irregularities and surface waviness of a charge-receiving member, suppressing discharge synchronicity lags from various parts of the charging member, and suppressing charging irregularities such as inadequate charging and the like.

The invention itself, together with further objects and attendant advantages, will best be understood by reference to the following detailed description taken in conjunction with the accompanying drawings.

BRIEF DESCRIPTION OF THE DRAWINGS

FIG. 30(D) is a perspective view showing another example of charging member construction;

DESCRIPTION OF THE PREFERRED EMBODIMENTS

The preferred embodiments of the present invention are described hereinafter with reference to the accompanying drawings.

Figure 1A:
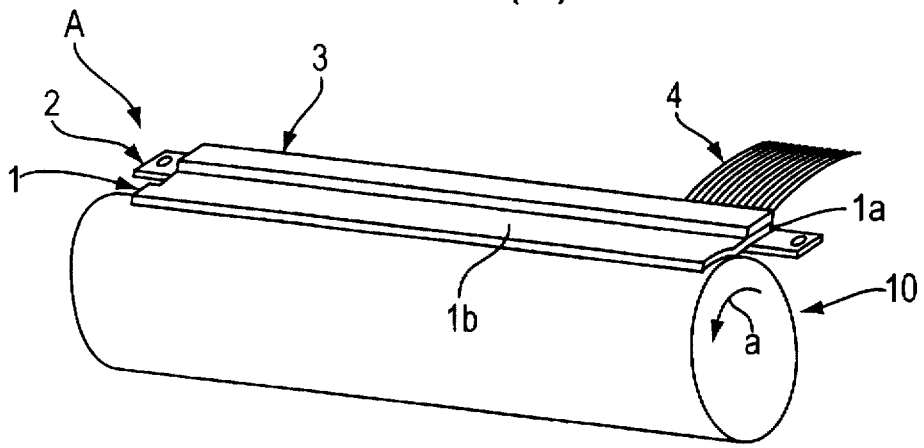
FIG. 1(A) is a perspective view showing the basic construction of an example of a charging device of the present invention.
Figure 1B:
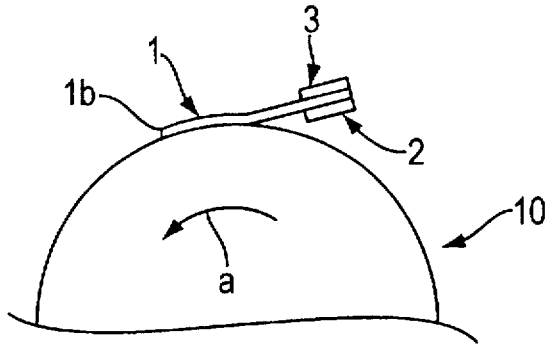
FIG. 1(B) is a side view of the charging device in FIG. 1(A)

FIG. 1(A) is a perspective view illustrating an example of the basic construction of a charging device of the present invention. FIG. 1(B) is a side view of the device of FIG. 1(A).

The charging device A shown in FIG. 1 is disposed opposite a drum shaped charge-receiving member 10. Charge-receiving member 10 is an electrostatic latent image-bearing member, and is rotated in the direction of arrow a, as shown in FIG. 1.

Charging device A is provided with a charging member 1, support member 2, and holding member 3. Charging member 1 is formed of a flexible material, and has a sheet-like configuration. Support member 2 and holding member 3 are disposed parallel to the rotational axis of direction of the charge-receiving member 10. The edge portion 1*a* of charging member 1 is gripped between support member 2 and holding member 3 on the upstream side of charge-receiving member 10 in the direction of rotation. The edge portion 1*a* of charging member 1 on the downstream side contacts the surface of the charge-receiving member 10 as the discharge tip. In other words, the upstream edge 1*a* of charging member 1 is supported by support member 2 and holding member 3, and charging member 1 is arranged along the direction of surface movement of the charge-receiving member 10. As described below, charging member 1 is provided with a plurality of flexible electrodes which are connected to a discharge driving power source or the like via signal cables.

Charge-receiving member 10 comprises an electrically conductive drum, the surface of which has a dielectric layer formed thereon. This dielectric layer can be formed of various materials insofar as such material can attain a suitable surface charge without destruction of the insulation by the discharge from charging member 1. The dielectric layer maintains a surface charge after the formation of an electrostatic image by charging device A until the latent image is developed by a developing device (not shown in figures). Furthermore, as described below, this dielectric layer can be used repeatedly by continuously discharging the surface charge after the image is developed. The developing device accommodates toner particles by which the latent image is developed. According to the rotation of the charge-receiving member 10, the developed image advance to a transfer position (not shown in figures). At the transfer position, the developed image is transferred to a sheet, e.g., paper. After the transfer of developed image, the charge-receiving member 10 advances to a discharging brush 16 (FIG. 18) and the latent image is erased by the discharging brush 16. After the erasing of the latent image, the charge-receiving member 10 advance to the charging member 1 again. Although the charge-receiving member 10 is a drum shaped member in the above example, a belt-like member or members of other configurations can be used as the charge-receiving member. Furthermore, a photoconductive layer can be substituted for the dielectric layer. When a photoconductive layer is used, the entire surface can be discharged by exposure to light.

FIGS. 2–9 illustrate exemplary embodiments of the previously mentioned charging member 1. All of these charging members 1 are suitable for use in the present invention. Each of the charging members 1 are provided with a plurality of flexible wire electrodes 12 on one side of a flexible sheet-like electrically insulated member 11 (hereinafter referred to as "flexible insulation member 11"). In the following description, on the side of the flexible insulation member 11 which is opposite the side provided with electrodes 12 is a free edge 111 disposed at the downstream side edge 1*b* of charging member 1, the surface of which on the charge-receiving member side contacts the charge-receiving member 10. According to this construction, a discharge gap equal to the thickness of the flexible insulation member 11 is formed between the edges of charge-receiving member 10 and the electrodes 12, so as to charge the charge-receiving member 10 via a discharge from the tip of the electrodes 12.

Figure 2:
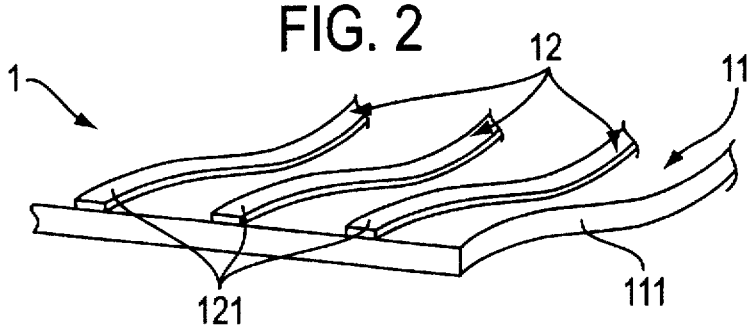
FIG. 2 is a partial perspective view of an example of a charging member in the device of FIG. 1.

In the charging member 1 of FIG. 2, each electrode 12 is a band-like electrode having a uniform width in the length direction. The electrodes 12 are arranged in parallel array.

The thickness of the flexible insulation member 11, and particularly the thickness of the tip and the portion adjacent thereto of free edge 111 is desirably about 5 μm to about 1,000 μm to obtain a suitable discharge. Furthermore, a thickness of about 5 μm to about 200 μm is desirable, depending on the material and Young's modulus of the flexible insulation member 11 to adequately respond to the surface irregularities and surface waviness of the charge-receiving member 10. The distance between the charge-receiving member 10 and the tip 121 of the flexible electrode 12 to which a discharge voltage is applied (i.e., the discharge gap), is maintained uniformly by means of the aforesaid thickness. Thus, the thickness of this portion is uniform and does not greatly affect the discharge generation. Although fluororesins (e.g., ethylene tetrafluoride resin), urethane rubber, polyimide, polyester and the like can be used to form the flexible insulation member 11, the present invention is not limited to these materials.

It is desirable that a wear-resistant material is used for the portion of the flexible insulation member 11 which comes into contact with the charge-receiving member 10. It is further desirable that the material have a small friction coefficient relative to the charge-receiving member 10.

Flexible electrodes 12 can comprise electrically conductive materials such as nickel, chrome, copper, gold, platinum, tungsten, aluminum, indium, titanium and the like, or combinations of one or more electrically conductive materials such as ITO, carbon and the like. The flexible electrodes 12 can be formed on the flexible insulation member 11 by a spattering method or the like after photo-etching of a pattern thereon, or by using a contact masking method using a excimer laser, mask image method, beam scanning method or the like.

There is concern that the flexible electrodes 12 formed on the flexible insulation member 11 can become corroded or soiled by products generated during discharge such as ozone, nitrogen oxides and the like. When the electrodes 12 become corroded or soiled, the desired stable discharge is unobtainable. Therefore, it is desirable to cover at least the surface of the flexible electrode tip 121 with a protective cover to prevent soiling and corrosion of the flexible electrode 12. This cover material can be a thin layer of inorganic metal oxide, diamond-like carbon layer or the like, but is not limited to these examples. Since both the insulation member 11 and electrodes 12 are both flexible, it is desirable that the covering be within a range which is not susceptible to cracking.

When the external impedance is reduced under high humidity conditions, there is concern of unstable discharging due to leakage between the electrodes 12 and the charge-receiving member 10. There is also concern of leakage between adjacent electrodes 12 and abnormal dot discharge under high humidity conditions. Accordingly, it is desirable that at least the flexible electrode tips 121 of flexible electrodes 12 have an electrical resistance value within a range of about $10^1$ Ω·cm to about $10^8$ Ω·cm so as to prevent leaks under high humidity conditions. Thus, at least the flexible electrode tip 121 is covered by a material 122 (e.g., carbon containing organic material) having a resistance higher than the flexible electrode 12 itself. The flexible electrode tip 121 itself can be formed from a semiconducting material. The electrode covering can be achieved using vacuum deposition, fluid application, or other means. In this case, the electrical resistance of flexible electrode tip 121 is increased, which prevents an excessive drive voltage, and eliminates discharge differences arising from differences in the thickness and length of this portion of the electrode.

The material of cover member 122 can be a material having relatively high resistance when the cover layer has a thickness of about 0.3 μm to several micrometers, but a relatively low resistance material is used when the thickness increases. It is desirable that a low discharge voltage be utilized.

The width of the electrode 12 is desirably within a range of several micrometers to about 100 μm. The distance between adjacent electrodes must be determined with consideration given to resolution and intra-electrode leakage, and it is desirable that the distance be within a range of about 30 μm to about 100 μm.

According to the charging device using a charging member 1 having a cover member (not shown), the impedance is increased between mutually adjacent electrode tips 121 because the electrode tips 121 are covered by a cover member, which has a higher resistance than the electrode body. Accordingly, intra-electrode leakage is adequately suppressed so as to allow stable charging of charge-receiving member 10 even when the electrode density is increased to obtain higher resolution images. Furthermore, stable charging of charge-receiving member 10 is accomplished even under conditions of high humidity.

Furthermore, the external impedance is increased because the electrode tips 121 are covered by the cover member, which has a higher resistance than the electrode body, such that leaks from the electrode tips 121 to the charge-receiving member (overcurrent) are suppressed even under conditions of high humidity. Accordingly, even greater stability of charging of the charge-receiving member is attained. The charge-receiving member can be charged without fear of insulation breakdown resulting from leaks to the charge-receiving member 10.

Another example of a charging member designed in accordance with the present invention is described below.

Figure 3:
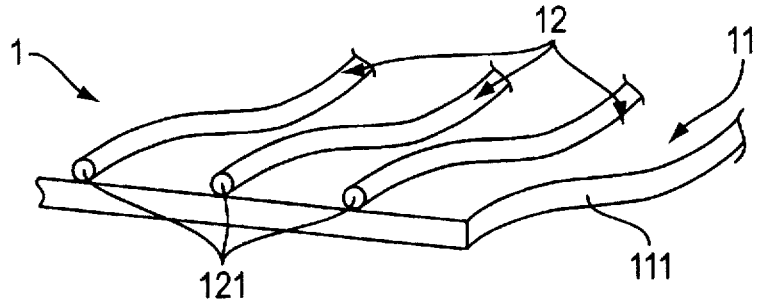
FIG. 3 is a partial perspective view of another example of a charging member in the device of FIG. 1.

The charging member 1 of FIG. 3 provides flexible electrodes 12 comprising tungsten wire, approximately 10–100 μm in diameter, which is permanently mounted on a flexible insulation member 11 by insulated adhesive or the like.

Figure 4A:
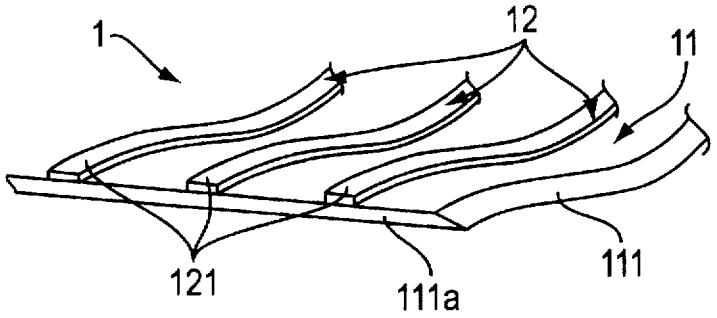
FIG. 4(A) is a partial perspective view of still another example of a charging member in the device of FIG. 1.
Figure 4B:
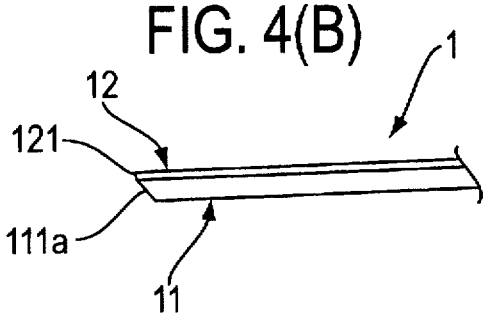
FIG. 4(B) is a side view of the charging member in FIG. 4(A)

The charging member 1 of FIG. 4 is a modification of the charging member of FIG. 2. The charging member 1 of FIG. 4 has an obliquely cut edge surface **111*a* of flexible insulation member edge 111 for supporting electrode tip 121 which is the discharging portion of flexible electrode 12. Thus, edge surface 111*a* protrudes hood-like in the surface movement direction of the charge-receiving member. As such, the surface area of electrode tip (i.e., discharging tip) 121** confronting the charge-receiving member is increased such that discharge readily occurs.

Figure 5:
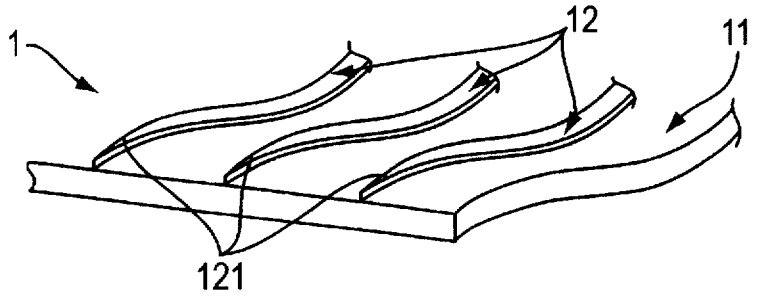
FIG. 5 is a partial perspective view of yet another example of a charging member in the device of FIG. 1.

The charging member 1 of FIG. 5 is a modification of the charging member 1 of FIG. 2. As shown in FIG. 5, each of the flexible electrodes of the charging member 1 has a tip 121 which is narrower than the other parts of electrode 12, such that discharge readily occurs from the tip 121. Since discharge by charging member 1 of FIG. 5 readily occurs, the drive voltage can be reduced, and the printing diameter can be made smaller.

Figure 6:
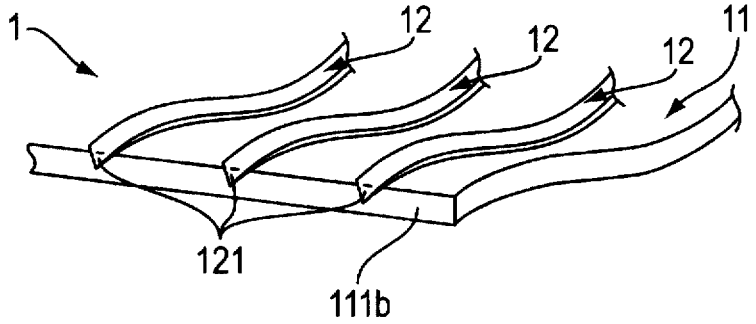
FIG. 6 is a partial perspective view of another example of a charging member in the device of FIG. 1.

The charging member 1 of FIG. 6 is another modification of the charging member 1 of FIG. 2. This charging member 1 provides a tip 121 of electrode 12 which overhangs the free end **111*b* of flexible insulation member 11**. Thus, the discharge area is increased, such that discharge readily occurs.

The charging members shown in FIGS. 3–6 comprise at least one electrode tip 121 covered by a cover member having a higher resistance than the electrode body in a charging device of the present invention.

Figure 7:
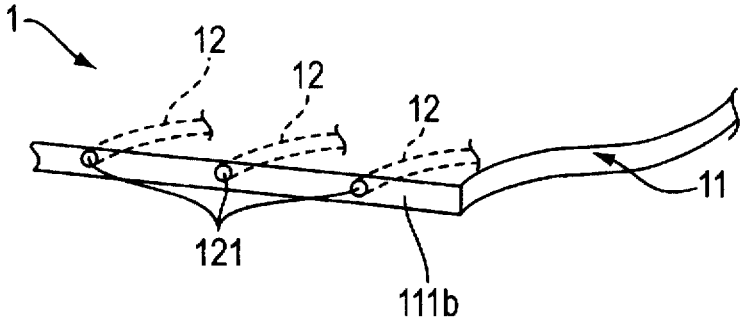
FIG. 7 is a partial perspective view of another example of a charging member in the device of FIG. 1.

The discharge member 1 of FIG. 7 provides flexible electrodes 12 within the flexible insulation member 11. The end face of discharge tip 121 of each flexible electrode 12 is exposed from the end face **111*b* of the flexible insulation member 11. This arrangement can be produced by methods which form the flexible insulation member 11 around the flexible electrodes 12. Furthermore, the flexible electrodes 12 can be sandwiched between two layers of flexible insulation member 11. Such constructions can prevent intra-electrode leakage from non-tip electrode areas under high humidity conditions. Such constructions can also be adapted to other charging members. For example, in the charging member of FIG. 2, a similar effect can be achieved by providing an electrically insulated member on the surface of the flexible insulation member 11 on the side with the flexible electrode 12** by means of fluid application, vacuum deposition, gluing and the like.

The charging member 1 of FIG. 7 comprises electrode tip 121 covered by a cover member 123 having a higher resistance than the electrode body, as indicated by the dashed lines in the drawing.

Figure 8:
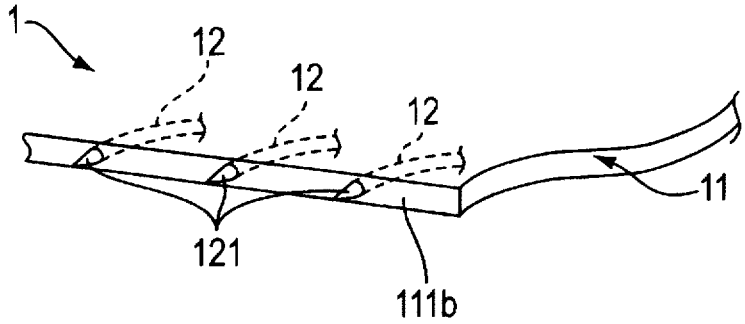
FIG. 8 is a partial perspective view of another example of a charging member in the device of FIG. 1.

The charging member 1 of FIG. 8 is similar to that of FIG. 7 in that the flexible electrodes 12 are provided within the flexible insulation member 11, but differs from the charging member 1 of FIG. 7 in that the discharge tips 121 of the flexible electrodes 12 protrudes from insulation member end face **111*b*. Since the space is widened between the discharge tip 121 and the charge-receiving member 10** according to this construction, discharge readily occurs.

Figure 9A:
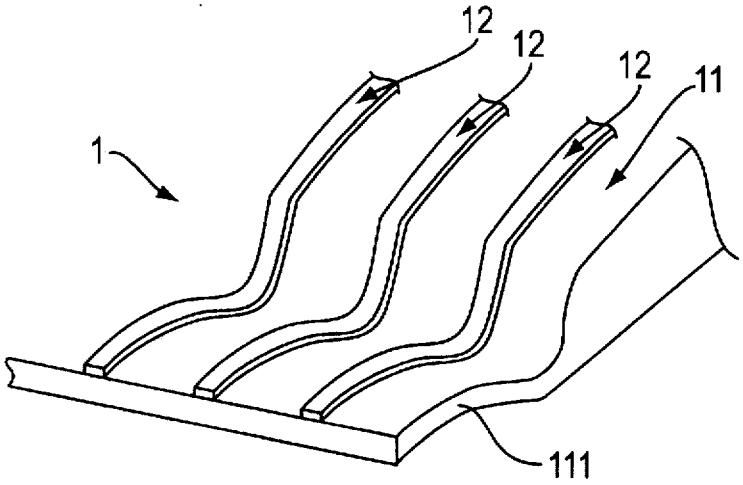
FIG. 9(A) is a partial perspective view of another example of a charging member in the device of FIG. 1.
Figure 9B:
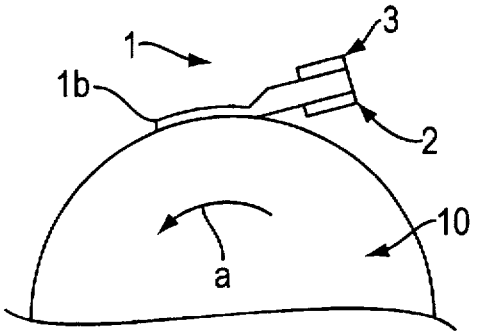
FIG. 9(B) is a side view of the charging device using this charging member.

The charging member 1 of FIG. 9 is provided with the free end 111 of flexible insulation member 11 having a thickness of about 5 μm to about 1,000 μm, although the adjacent portion supporting the flexible insulation member 11 are thicker by several hundred micrometers to several millimeters. As shown in FIG. 9(B), the area proximate to the thin portion and thick portion of the flexible insulation member 11 is the area of contact between the flexible insulation member 11 and the charge-receiving member 10. In the charging member 1 of FIG. 9, the support is provided by the thick portion of the flexible insulation member 11 such that rigidity is increased in the vicinity of the supported area of the flexible insulation member 11, so as to set the portion of contact between the flexible insulation member 11 and the charge-receiving member 10. Accordingly, there is negligible oscillation of the flexible insulation member 11 in the direction of surface movement of the charge-receiving member 10 in conjunction with the movement of the charge-receiving member 10, thereby suppressing printing irregularities.

Figure 11A:
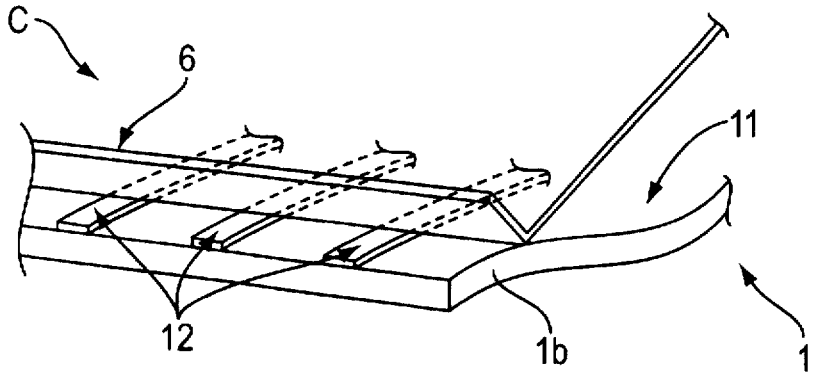
FIG. 11(A) is a partial perspective view of an example of a charging device having a different basic construction than the charging device of FIG. 1.
Figure 11B:
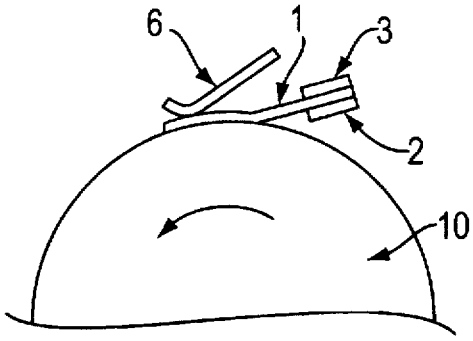
FIG. 11(B) is a side view of the charging device in FIG. 11(A)
Figure 12:
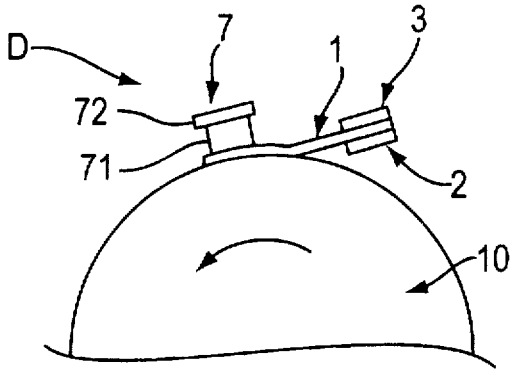
FIG. 12(A) is a partial perspective view of an example of a charging device having a different basic construction than the charging device of FIG. 1.
FIG. 12(B) is a side view of the charging device in FIG. 12(A)

FIGS. 10–12 show charging devices of the present invention. These charging devices differ somewhat from the basic construction of the charging device of FIG. 1.

Figure 10A:
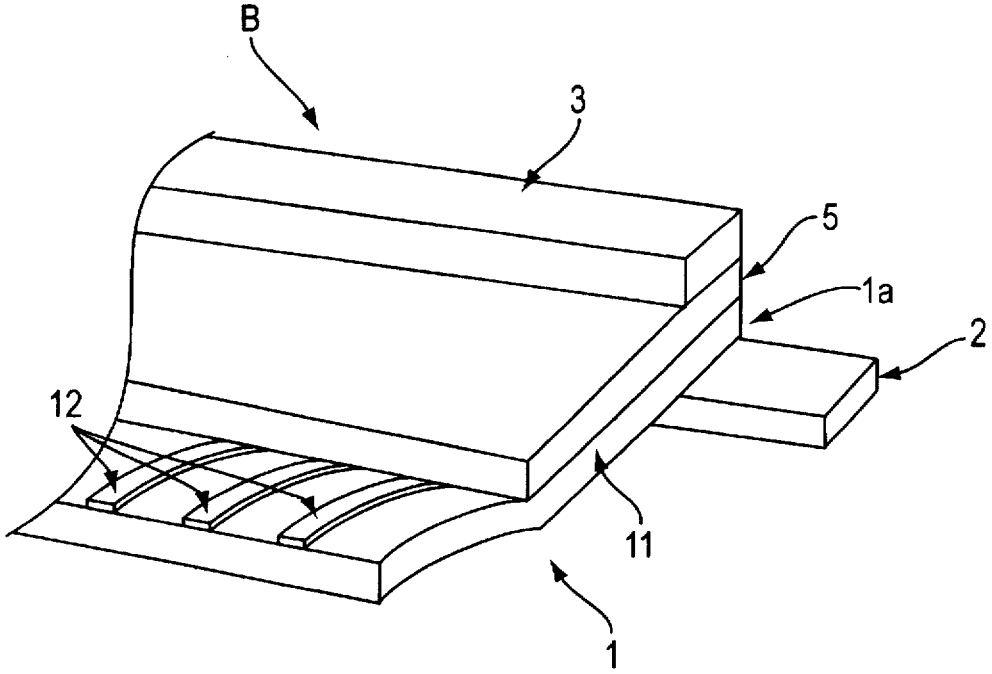
FIG. 10(A) is a partial perspective view of an example of a charging device having a different basic construction than the charging device of FIG. 1.
Figure 10B:
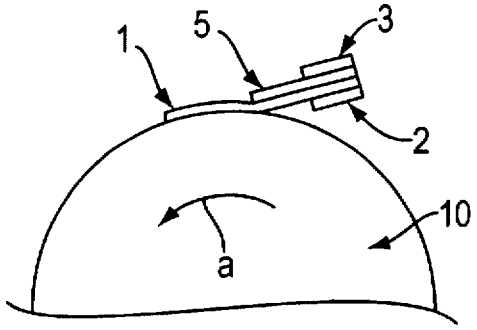
FIG. 10(B) is a side view of the charging device in FIG. 10(A)

Charging device B shown in FIGS. 10(A) and 10(B) provides an elastic member 5 having a portion supported by a support member 2 and a holding member 3. Elastic member 5 is sandwiched together with charging member 1 between the support member 2 and holding member 3. In other respects, the charging device is identical to the charging device A shown in FIG. 1. The charging member 1 is pressed by the elastic member 5 so as to set a starting area of contact between the charging member 1 or flexible insulation member 11 and the charge-receiving member 10 as shown in FIG. 10(B). Specifically, the portion of the downstream end of elastic member 5 presses charging member 1, and establishes an area of starting contact between flexible insulation member 11 and charge-receiving member 10. In charging device B, there is scant oscillation of flexible insulation member 11 in the direction of surface movement of charge-receiving member 10 in conjunction with the surface movement of said charge-receiving member 10.

Charging device C, shown in FIGS. 11(A) and 11(B) is provided with a charging member 1, which is pressed against the charge-receiving member 10 by a pressure member 6 similar to the charging member 1 in the charging device A of FIG. 1. Pressure member 6 presses near the edge 1*a* of the charging member 1, so as to maintain a uniform distance between flexible electrodes 12 and charge-receiving member 10. In charging device C, charging member 1 conforms well to the charge-receiving member 10 and compensates for any pronounced surface waviness and eccentricity of the charge-receiving member 10.

Charging device D, shown in FIG. 12, presses a charging member 1 against the charge-receiving member 10 by a pressure member 7 similar to the charging member 1 in the charging device A of FIG. 1. Pressure member 7 comprises a pressure support member 72 and a pressure member 71, which apply pressure near the tip 1*b* of the charging member 1, to maintain a uniform distance between the flexible electrode 12 and the charge-receiving member 10. In charging device D, charging member 1 conforms well without any pronounced surface waviness and eccentricity of the charge-receiving member 10, just as in the previously described charging device C. Pressure member 71 may be formed of a material such as urethane foam, silicone rubber foam and the like, which is capable of transmitting adequate pressure force to the charging member and has characteristics to adequately achieve suitable conformity between the charging member 1 and the charge-receiving member 10 relative to pressure transmitted.

Figure 13:
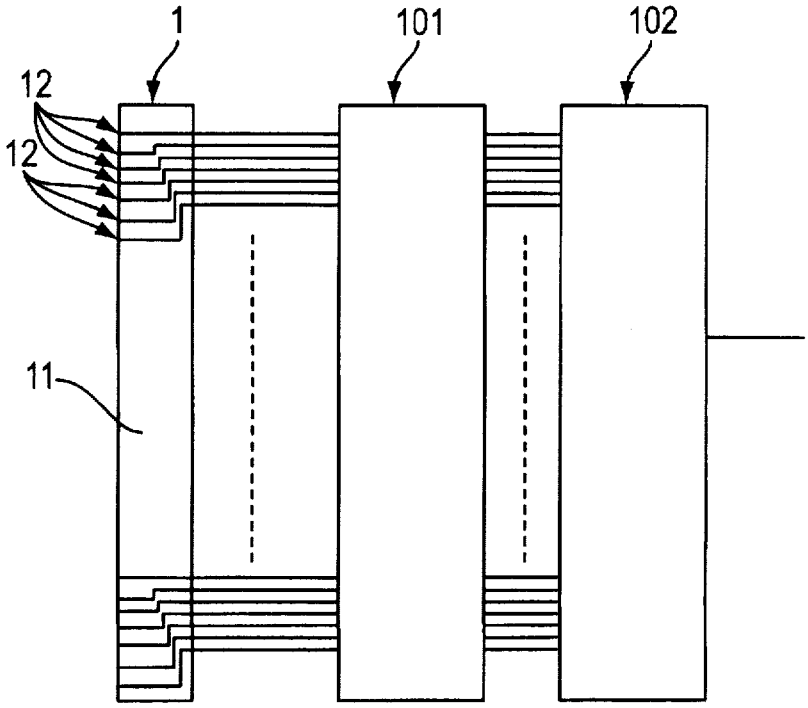
FIG. 13 shows an example of an electrical circuit usable in the charging device of the present invention.

FIG. 13 shows an example of an electrical circuit for use in the charging devices according to the present invention, including the previously described charging devices.

According to this electrical circuit, print signals corresponding to an image to be printed are formed by an image signal forming unit 102 and output to a drive power unit 101. Drive power unit 101 boosts the print signal to a high voltage, and said high voltage signal is supplied to each flexible electrode 12 of the charging member 1. The electrically conductive support member of charge-receiving member 10 is grounded.

Conversely, a high voltage can be supplied to the conductive support member of the charge-receiving member 10, and the various electrodes 12 may be grounded in accordance with the print signal.

These methods can be combined, such that a high voltage is supplied to the various flexible electrodes 12 in accordance with print signals, and a bias voltage having a polarity opposite the polarity of the print signal can be supplied to the conductive support member, so as to reduce the voltage supplied to the flexible electrodes 12.

Figure 14:
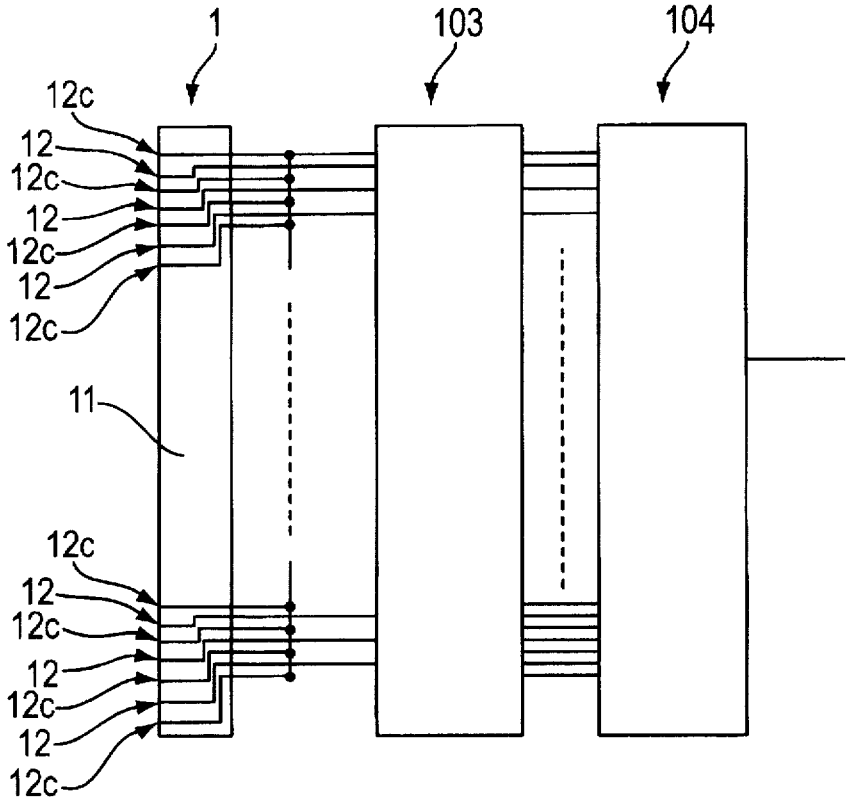
FIG. 14 shows another example of an electrical circuit usable in the charging device of the present invention.

FIG. 14 shows another example of an electrical circuit for the charging devices of the present invention. In this example, the charging member 1 is provided with a plurality of flexible control electrodes 12*c*. Specifically, flexible control electrodes 12*c* are provided on the exterior sides of the end flexible electrodes 12 and between adjacent flexible electrodes 12. According to this electrical circuit, print signals corresponding to an image to be printed are formed by an image signal forming unit 104, and output to a drive power unit 103. The drive power unit 103 boosts the print signal to a high voltage, and the high voltage signal is supplied to the various flexible electrodes 12 of charging member 1. A voltage is also supplied to the various flexible control electrodes 12*c*. The voltage supplied to the flexible control electrodes 12*c* can be, for example, a voltage intermediate of the ground voltage and the voltage supplied to electrodes 12, to reduce the difference in potential between the flexible electrodes 12 and the control electrodes 12*c* and prevent intraelectrode leakage. Furthermore, supplying such an intermediate voltage minimizes the effects of interacting potentials of adjacent electrodes 12, and stabilizes the print diameter. The print diameter can also be reduced by supplying the aforesaid voltage to the control electrodes 12*c*. In particular, when looking at a single discharge electrode 12, the angle at which the discharge spreads from the discharge electrode 12 is controlled by supplying a voltage to the control electrodes 12*c* disposed bilaterally thereto (said angle being narrowed in accordance with the voltage supplied to the control electrode 12*c*, thereby reducing the print diameter.

Figure 15:
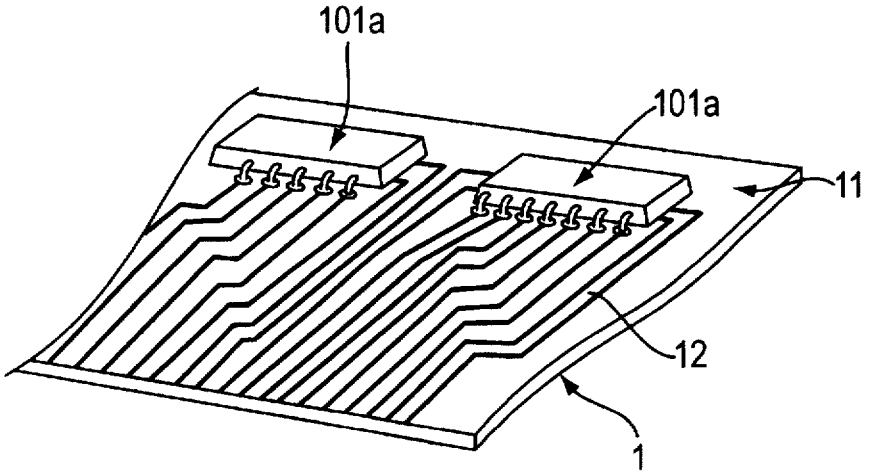
FIG. 15 shows still another example of an electrical circuit usable in the charging device of the present invention.

FIG. 15 shows still another example of an electrical circuit for the charging device of the present invention. In this example, the charging member 1 is provided with flexible electrodes (discharge electrodes) 12, and a print signal boosted to a high voltage is supplied to the flexible electrodes 12 from drive power units 101*a* of an integrated circuit mounted directed on flexible insulation member 11. This construction allows the circuit to be more compact, and reduces the number of signal cables, as well as the size of the charging member and the charging device itself.

The table below shows examples of the relationships between the voltage supplied to the flexible electrodes (discharge electrodes) 12 of charging member 1, and the thickness of the tip 111, or portion proximate thereto, of flexible insulation member 11 opposite the electrode tip in the charging member 1, in the charging device of the present invention. In the example, the discharge voltage polarity is positive. Although, in general, the discharge may be accomplished when voltages in excess of those shown below are supplied. The print diameter increases when excess voltage is supplied.

| Thickness of Flexible Insulation Member 11 (μm) | Voltage Supplied to Electrode 12 (V) |
|---|---|
| 5 | 400 |
| 50 | 700 |
| 100 | 1,000 |
| 300 | 1,200 |
| 1,000 | 1,700 |

Figure 16:
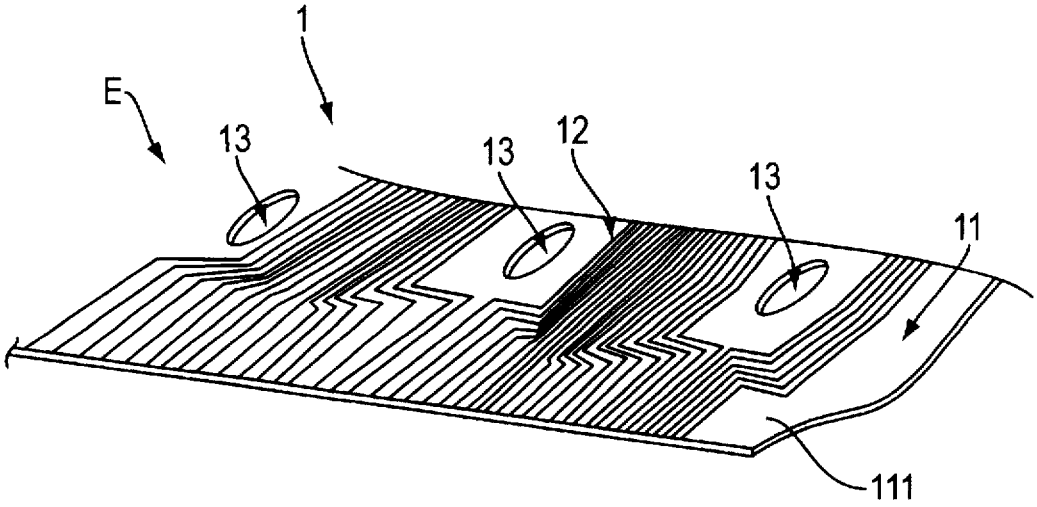
FIG. 16 is a partial perspective view showing the charging member in an embodiment of the present invention.

An embodiment of the present invention is described below with reference to FIG. 16. FIG. 16 is a perspective view showing the essential part of an embodiment of the present invention. The charging device E in this embodiment, although not shown in its entirety, has a basic construction identical to that of the charging device A shown in FIG. 1, with the exception that the charging member shown in FIG. 16 is used as the charging member 1 in charging device A. The electrical circuit shown in FIG. 13 is also used. Charging member 1 of FIG. 16 provides a plurality of flexible electrodes 12 on one side of a flexible insulation member 11, and ventilation holes 13 are formed in flexible insulation member 11 in the part downstream from the support region (tip 1*a* on the upstream side in the direction of surface movement of the charge-receiving member) of support member 2 and holding member 3 of charging member 1. The positions at which ventilation holes 13 are provided are positions which do not come into contact with the charge-receiving member 10 while said charge-receiving member 10 is rotating. The various electrodes 12 are disposed so as to avoid the ventilation holes 13.

According to charging device E, charging member 1 which has a sheet-like flexibility makes contact with the charge-receiving member 10 at the tip 111 on the downstream side of flexible insulation member 11. In this contact state, a discharge is generated from flexible electrodes 12 to the charge-receiving member 10 to charge the surface of said charge-receiving member 10.

Since the airflow generated by the rotation of the charge-receiving member 10 escapes through the ventilation holes 134 provided in charging member 1, lifting of the charging member 1 is suppressed. Since charging member 1 has sheet-like flexibility, it conforms well to the surface irregularities and the surface waviness of the charge-receiving member 10. Accordingly, there is no fluctuation in the discharge distance between the various electrodes 12 and the charge-receiving member 10. In addition to the aforesaid lifting force that is a problem with the conventional art, a force is also added to the flexible insulation member 11 in the direction of extension via a friction force at the contact region generated by the rotation of the charge-receiving member 10. These combined forces caused an oscillation of the flexible insulation member 11 in the direction of surface movement of the charge-receiving member 10. This oscillation generates a discharge timing dislocation at the tip of each electrode in the direction of surface movement of the charge-receiving member, which leads to discharge synchronicity lag. There is a concern that the electrodes 12 may break because this oscillation also causes a fluctuation in the amount of curvature of the flexible insulation member 11, and adds a repeated bending stress to the flexible electrodes 12 provided on flexible insulation member 11. In the charging device E of the present embodiment, however, the air escapes through the ventilation holes 13, such that said airflow produces no effect on charging member 1. Any oscillation of charging member 1 is suppressed in the direction of surface movement of the charge-receiving member. Accordingly, in the charging device E of the present embodiment, discharge synchronicity lags of the electrodes 12 are suppressed. Thus, in the charging device E of the present embodiment, excellent charging is accomplished because suppressing abnormal and irregular charging is suppressed. As a result, excellent images are produced. Furthermore, the use of ventilation holes provide the advantage of making it difficult for the electrodes to break.

Ventilation holes 13 also can be added to the charging members 1 shown in FIGS. 2–15 so that these charging members also can provide the benefit of the above described advantages.

Figure 17:
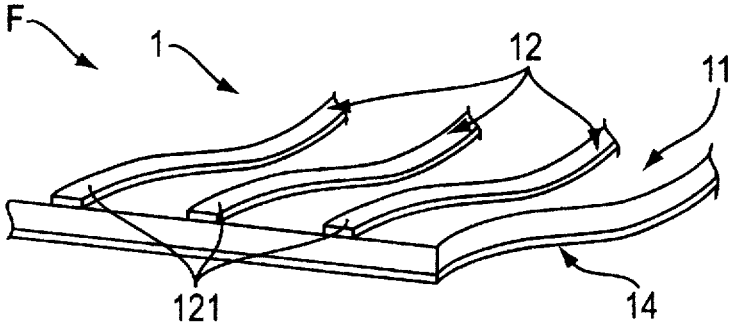
FIG. 17 is a partial perspective view showing the charging member in another embodiment of the present invention.

FIG. 17 shows the essential portion of another embodiment of the invention. FIG. 17 does not show the entirety of a charging device F, but rather shows the essential portion of a charging member 1 in accordance with the present invention. The charging member 1 has a basic construction identical to that of charging device A shown in FIG. 1. A semiconductive member 14 comprising a semiconductive material is laminated on the entire surface on the charge-receiving member side of flexible insulation member 11 and is used as the charging member in charging device A. The semiconductive member 14 is for making contact with the charge-receiving member 10.

Although the semiconductive member 14 is provided on the entire surface of flexible insulation member 11 on the charge-receiving member side in charging member 1 of FIG. 17, said semiconductive member 14 alternatively may be provided only in the vicinity of the discharge tip 121 of flexible electrode 12 required to achieve a uniform discharge distance.

The semiconductive member 14 may be formed by mixing a semiconductive material or a conductive material with materials such as synthetic resins such as fluororesin, polyimide, polyester and the like, and synthetic rubbers such as urethane and the like, but is not limited to these materials. The semiconductive member 14 may be formed by fluid application of a semiconductive material, spattering and the like. However, the semiconductive member forming method is not limited to the aforesaid. Since the semiconductive member 14 is the part that contacts and rubs against the charge-receiving member 10, it is desirable that a wear resistant material be used. It is further desirable that such material have a small friction coefficient relative to the charge-receiving member from the perspective of the torque produced on charge-receiving member 10. Furthermore, residual materials, such as toner used for developing an image, accumulate on the charging device even when a cleaning device is provided for the charge-receiving member. Therefore, it is desirable that the material used have release characteristics relative to the toner used for developing so as to prevent the fusion of said toner to the charging member. A resistance value in the range of about $10^1$ Ω·cm to about $10^8$ Ω·cm is suitable for the semiconductive member.

The semiconductive member 14 is connectable to a drive power unit, which supplies a voltage. The level of the supplied voltage should preferably be at a level that does not cause a charging of the charge-receiving member 10 by the semiconductive member 14, however, the level of the supplied voltage is not specifically limited. On the other hand, the level of the supplied voltage is dependent on the material and resistance value of the semiconductive member 14. If the difference between the surface potential of the charge-receiving member 10 and the voltage applied to semiconductive member 14 is less than 550 V, the charge-receiving member should not be charged by the semiconductive member 14. Thus, if the level of potential of the charge-receiving member is zero (0 V), the voltage supplied to the semiconductive member 14 can be suitably about −550 V to about +550 V. The use of the semiconductive member 14 provides the advantage that when a voltage is supplied to semiconductive member 14, the semiconductive member 14 is adhered to the charge-receiving member 10 by electrostatic force.

Figure 18:
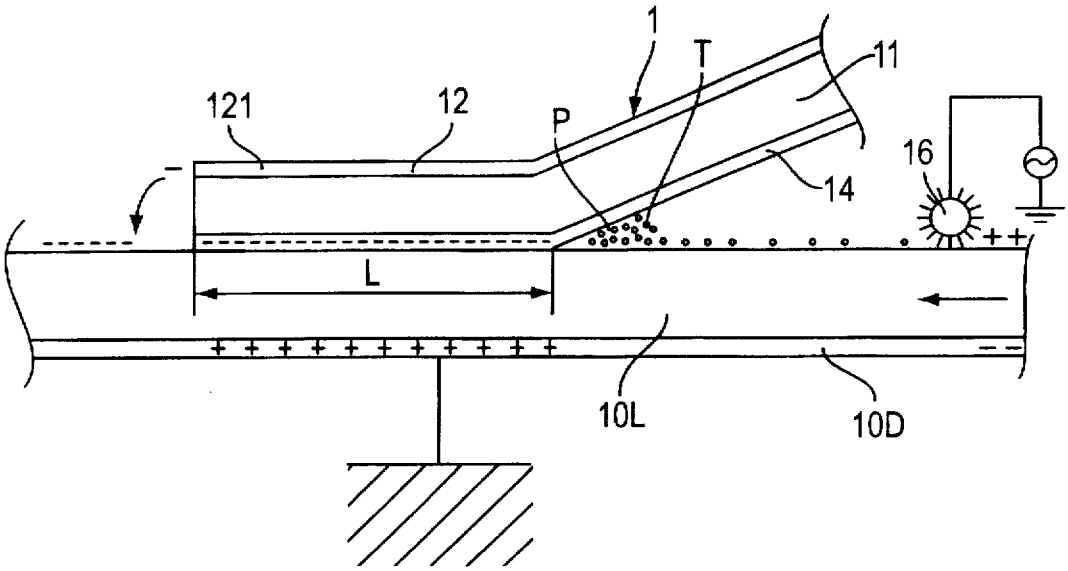
FIG. 18 illustrates the electrostatic attraction of the charging member provided with a semiconductive member.

As best depicted in FIG. 18, an electrostatic force is developed between the semiconductive member 14 and the charge-receiving member 10. Consider, for example, a case wherein the dielectric layer surface 10L of a rotating charge-receiving member 10 is discharged beforehand by a discharge brush 16 supplied with an AC voltage before arriving under or contacting the charging member 1. A negative voltage is supplied to semiconductive member 14. A negative voltage is supplied also to the electrodes 12. The portion of the charge receiving member 10 charged with a positive charge during the transfer process, i.e., the conductive drum 10D of the charge-receiving member 10, is excited by the negative charge of the semiconductive member 14. Then, when this portion of the charge receiving member 10 arrives at the discharge brush, the discharge brush eliminates the positive charge from the surface of the charge-receiving member 10 so as to attain a surface potential of zero (0 V). Next, when this portion of the charge receiving member 10 arrives again under the charging member 1, the conductive drum 10D is again excited by the negative charge passing through the dielectric layer via the negative charge of semiconductive member 14. An electrostatic attraction force is generated between the negative charge of the semiconductive member 14 and the aforesaid positive charge, and semiconductive member 14 is adhered to the charge-receiving member 10. When the surface of the charge-receiving member 10 passes the semiconductive member 14, a negative charge is passed from the electrodes 12 to said surface, thereby charging said surface. Albeit the charge-receiving member 10 is shown as being grounded in FIG. 18, a predetermined positive potential may be maintained thereon as another variation.

The polarity of voltage supplied to the semiconductive member 14 should preferably be the same as that of voltage supplied to the electrodes 12. If the polarity of the semiconductive member 14 is different from that of the electrodes 12, the difference of the potential between the electrodes 12 and the semiconductive member 14 will be larger than the difference of the potential between the electrodes 12 and the surface of the charge-receiving member 10, and the negative charge from the electrodes 12 may improperly pass to the semiconductive member 14. On the other hand, in a case that the polarity of the semiconductive member is same as that of the electrodes 12, the difference of the potential between the electrodes 12 and the semiconductive member 14 will be smaller than the difference of the potential between the electrodes 12 and the surface of the charge-receiving member 10, and the negative charge from the electrodes 12 will properly pass to the charge-receiving member 10.

Hence, in this figure, character T shows residual toner particles which remain on the charge-receiving member 10 after the transfer of developed image. Although the residual toner particles T advanced to the charging member 1 in accordance with the movement of the charge-receiving member 10, they are kept back at position P. In this embodiment, the residual toner particles T are hardly carried away from the position P, inasmuch as the charge-receiving member 10 is adhered to the charging member 1 by the electric attraction force. Further, in this embodiment, even if the residual toner particles T are carried away from the position P, the residual toner particles T hardly advance to the discharge region to which the negative charge are passed from the electrodes 12 and the soiling in the discharge region and its vicinity is effectively prevented, inasmuch as the electrodes 12 discharge the negative charge from the most downstream side of the charging member 1. Therefore, the residual toner particles T carried away from the position P hardly do harmful influence to the negative charge from the electrodes 12. From this point of view, the contact length L of the charging member 1 should preferably be about 3 mm or more. In addition, the charging member 1 of this embodiment can keep back foreign matter, such as recording paper debris and the like, at the position P.

The other advantage of using the semiconductive member 14 is that the discharge tip 121 of the flexible electrodes 12 and the charge-receiving member 10 are maintained at a uniform discharge distance by means of the aforesaid electrostatic attraction force. The charging member 1 remains in stable contact with the charge-receiving member 10 via the action of this electrostatic attraction even when an airflow is generated by the rotation of the charge-receiving member 10. Furthermore, each part of the flexible insulation member 11 is maintained in uniform contact with the charge-receiving member 10 via the flexibility of the charging member 1, regardless of surface irregularities and surface waviness on the charge-receiving member 10. As a result, there is no fluctuation in the discharge distance between the charge-receiving member 10 and the various electrodes 12. Any oscillation of the charging member 1 is also suppressed in the direction of surface movement of the charge-receiving member 10, thereby suppressing discharge synchronicity lag among the various electrodes 12. Thus, excellent charging is accomplished by suppressing any inadequate charging and thereby excellent images can be produced. Another advantage is that the electrodes 12 are more difficult to break.

In another variation, a member comprised of an electret material can be substituted for the semiconductive member 14. Similar advantages can be achieved with an electret member used in place of a semiconductive member. However, in addition to the similar advantages, an electret member does not need a power source. In a case of using an electret member, the polarity of the electret member should preferably be same as that of the voltage supplied to the electrodes 12, because of the same reason of the case of the semiconductive member 14.

Materials useful for forming an electret member include suitably processed sheet-like electret materials such as PFA (perfluoroalkoxy), FEP (fluoroethylenepropylene), fluorinated ethylene propylene resin and the like. The electret can be formed by a process wherein a suitable electret material is maintained at about 150° C. to about 200° C. while the surface of the electret material is subjected to corona irradiation or electron beam irradiation. Then the temperature is gradually reduced during the irradiation period until room temperature is reached and the irradiation is terminated. A semi-permanent charging member having different polarities on bilateral surfaces of the electret material may be obtained by the aforesaid process.

Figure 20A:
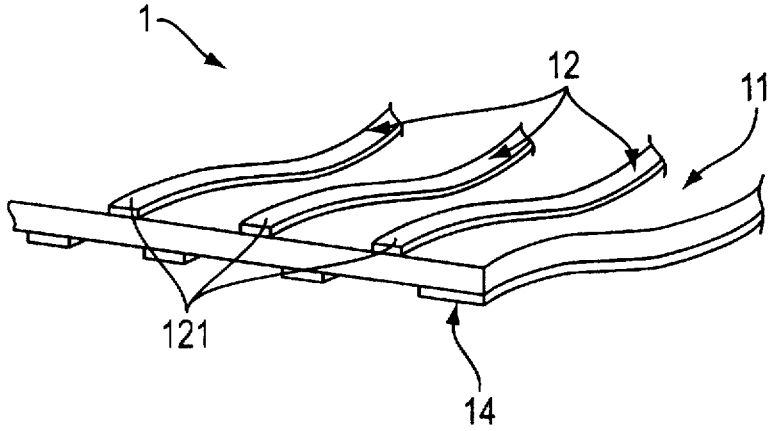
FIG. 20(A) is a partial perspective view of another example of a charging member which can be substituted for the charging member of FIG. 17.
Figure 20B:
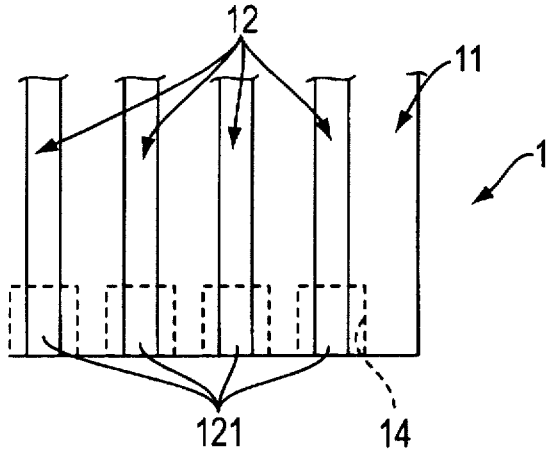
FIG. 20(B) is a front view of the charging member in FIG. 20(A)
Figure 21:
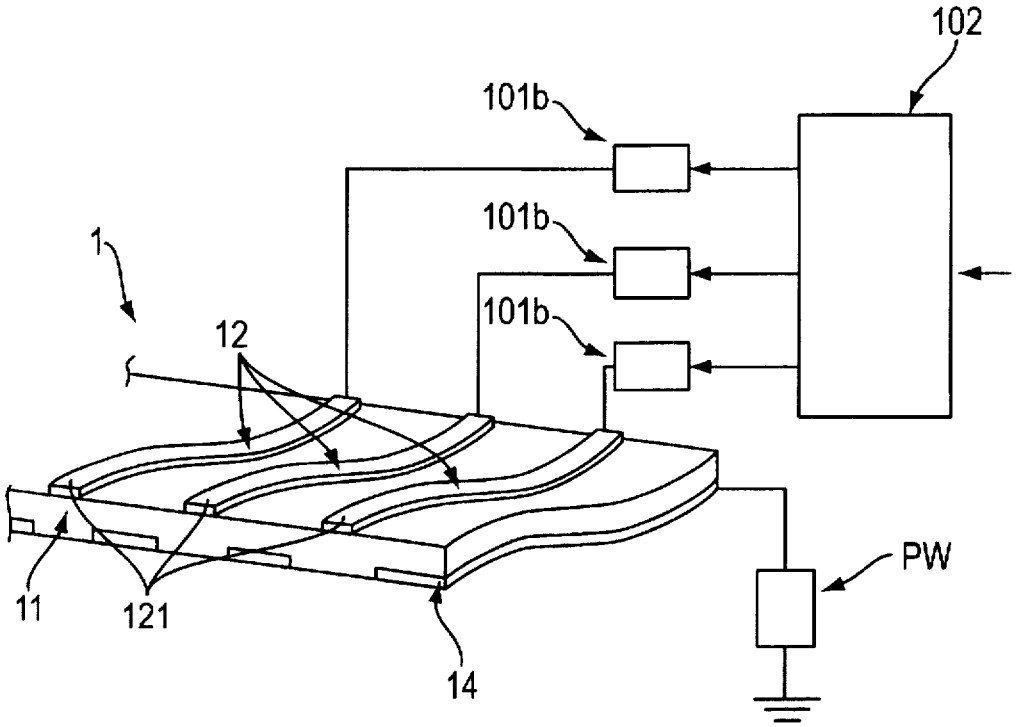
FIG. 21 is a partial perspective view of another example of a charging member which can be substituted for the charging member of FIG. 17, and an electrical circuit of a charging device using said charging member.

In yet another variation, the semiconductive members 14 shown in FIGS. 19, 20 and 21 may be substituted for the semiconductive member 14 of FIG. 17.

Figure 19A:
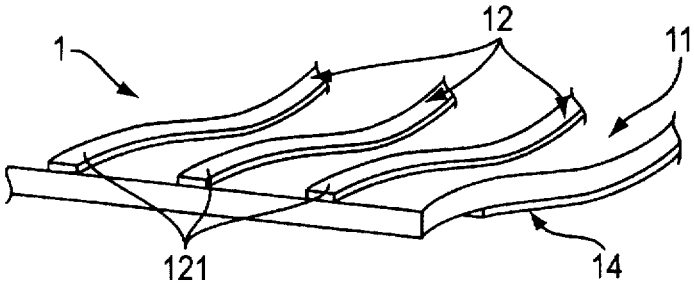
FIG. 19(A) is a partial perspective view of an example of a charging member which can be substituted for the charging member of FIG. 17.
Figure 19B:
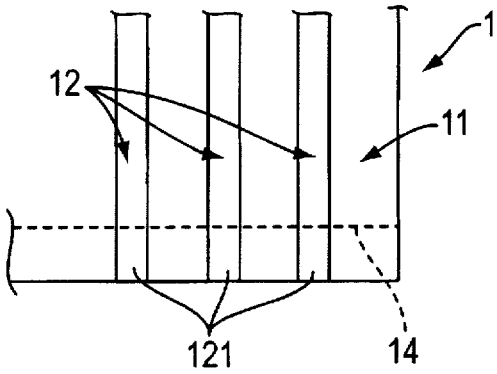
FIG. 19(B) is a front view of the charging member in FIG. 19(A)

The semiconductive member 14 of FIGS. 19(A) and 19(B) is provided so as to be partially omitted in the vicinity of the tip 121 of flexible electrodes 12. This arrangement is effective in preventing print insufficiencies caused by leaks from the discharge tip 121 of a flexible electrode 12 to the semiconductive member 14. The region not provided with semiconductive member 14 desirably extends from about 30 μm to about 100 μm from the edge of the flexible insulation member 11.

The semiconductive member 14 of FIGS. 20(A) and 20(B) has a comb tooth shape in the vicinity of the tip 121 of the flexible electrodes 12, and is disposed such that the flexible electrodes 12 and semiconductive member 14 are in an alternating arrangement. This arrangement is effective in preventing print insufficiency due to leaks between electrodes 12 and semiconductive member 14 due to the longer distance between the discharge tip 121 of flexible electrodes 12 and the semiconductive member 14. The uniformity of the distance between electrodes 12 and charge-receiving member 10 is due to the required electrostatic attraction in the vicinity of the tip of flexible electrodes 12. In this example, the discharge is more stable than the semiconductor member 14 shown in of FIGS. 19(A) and 19(B) because a uniform distance is maintained between the charge-receiving member 10 and electrode tip 121.

The semiconductive member 14 of FIG. 21 has a comb tooth shape in the vicinity of tip 121 of the flexible electrodes 12, and is disposed such that the flexible electrodes 12 and the semiconductive member 14 are in an alternating arrangement. The semiconductive member 14 is partially embedded in flexible insulation member 11, such that said members 11 and 14 have identical surface positions. FIG. 21 also shows the electrical circuit of the charging device using this semiconductive member 14. According to this electrical circuit, print signals corresponding to an image to be printed are formed by an image signal forming unit 102 and output to drive power units 101*b*. Drive power units 101*b* boost the print signals to high voltage, and supply the high voltage signals to the various flexible electrodes 12. Furthermore, a voltage is supplied from power source PW to the semiconductive member 14. This electrical circuit also may be used in the charging devices using the charging members of FIGS. 17, 19(A), and 20(A).

The semiconductive member 14 may also be provided with a discharge function. Charging and discharging conditions are shown in FIGS. 22(A)–22(D) and 23(A)–23(D).

Figure 22A:
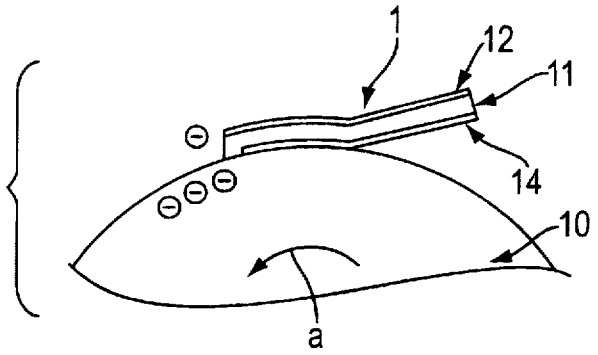
FIGS. 22(A)–22(D) illustrate the discharge function of the semiconductive member on the charging member provided with said semiconductive member.
Figure 22B:
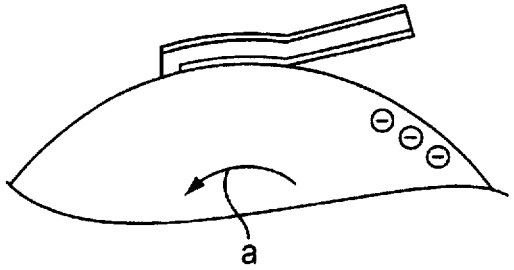
Figure 22C:
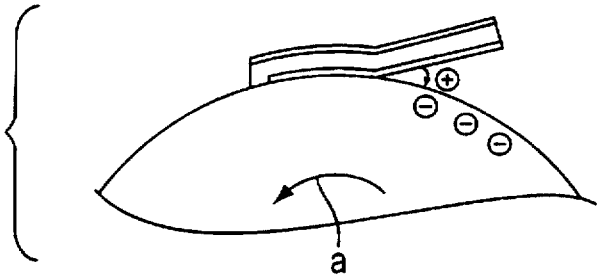
Figure 22D:
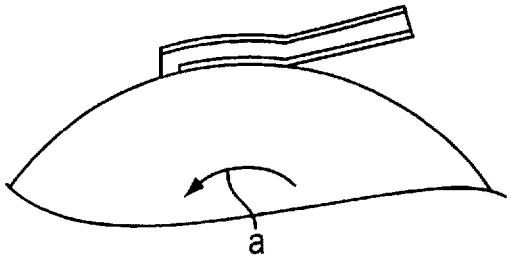
Figure 23A:
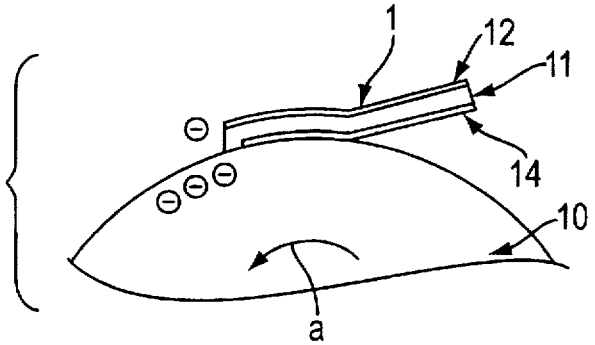
FIGS. 23(A)–23(D) illustrate another example of the discharge function of the semiconductive member on the charging member provided with said semiconductive member.
Figure 23B:
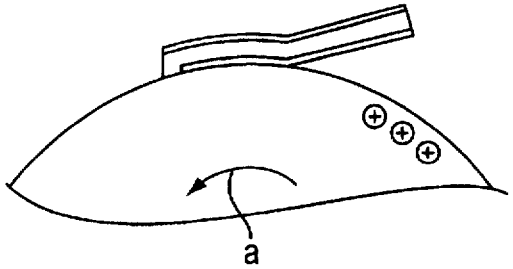
Figure 23C:
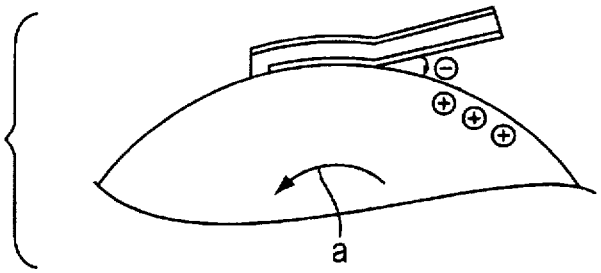
Figure 23D:
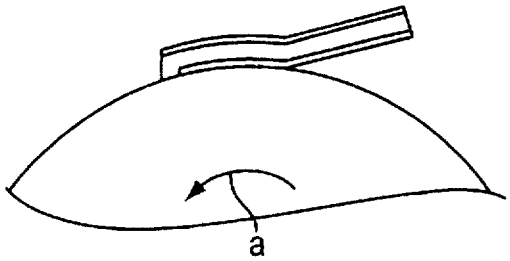

FIG. 22(A) illustrates the conditions when a negative voltage is supplied to flexible electrodes 12 for printing; the charge-receiving member 10 is negatively charged. Then, FIG. 22(B) illustrates the charge-receiving member 10 that has been subjected to developing, transfer, cleaning and like processes, just before it again arrives at charging member 1. When the polarity of the charge-receiving member 10 differs from the polarities of the developing process and transfer process, e.g., when the charge-receiving member is negatively charged, said charge-receiving member is positively charged if a positive potential is supplied to semiconductive member 14. Although dependent on the resistance value of the semiconductive member 14, a discharge to a zero potential can be achieved if, for example, a voltage of about +550 V to about +600 V is supplied, as shown in FIG. 22(C). As shown in FIG. 22(D), the charge-receiving member 10 does not maintain its charge after the aforesaid discharge.

FIGS. 23(A)–23(D) illustrate the conditions when a charge-receiving member 10 is positively charged for the developing process and transfer process.

In another variation, the charging members 1, respectively shown in FIGS. 17 and 19–23, also can be provided with ventilation holes 13 as shown in the charging member 1 of FIG. 16. The modification of these charging members with ventilation holes produces excellent charging by suppressing charge irregularities even more advantageously. The combination of a semiconductor member or electret member and the ventilation holes produces excellent images even more reliably. Conversely, a semiconductive member 14 or electret member may be provided at least on part of the surface of charging member 1 on the charge-receiving member 10 side shown in FIG. 16.

Another embodiment of the present invention is described hereinafter with reference to FIG. 24.

Figure 24A:
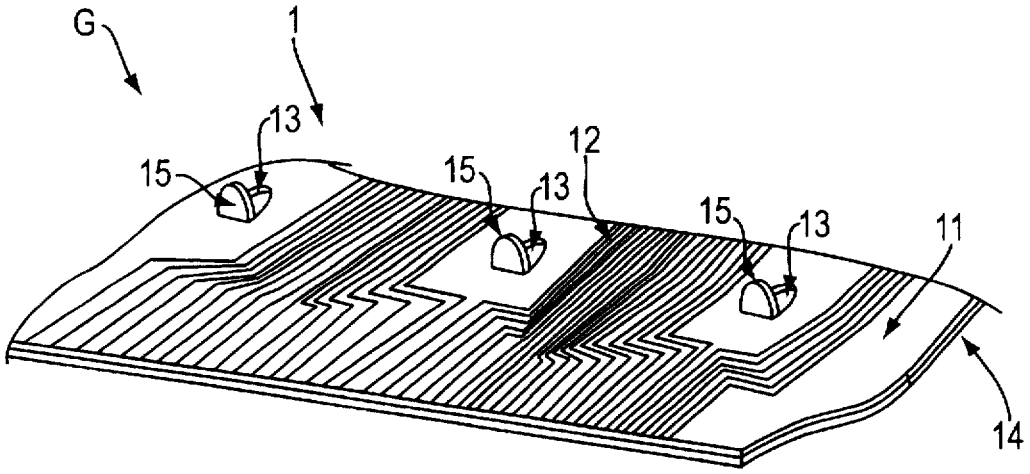
FIG. 24(A) is a partial perspective view of an example of a charging device in another embodiment of the present invention.
Figure 24B:
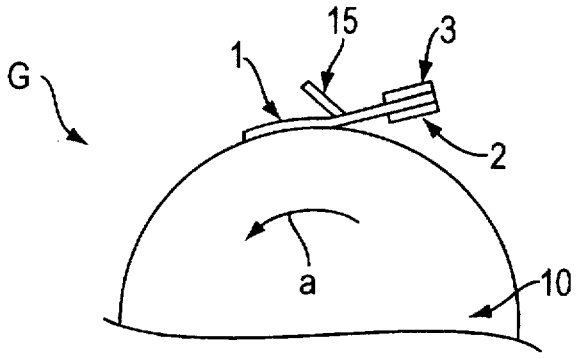
FIG. 24(B) is a side view of the charging device in FIG. 24(A)same.

Charging device G, shown in FIGS. 24(A) and 24(B), provides a semiconductive member 14 on the entire surface of charging member 1 on the charge-receiving member 10 side, as previously described with respect to the charging device E in FIG. 16. Also, the charging device G has pressure fins 15 rising on the downstream side of ventilation holes 13 in the direction of surface movement of charge-receiving member 10. These fins 15 receive the force of the airflow passing through the ventilation holes 13 during the rotation of a charge-receiving member.

According to charging device G, the airflow generated by the rotation of a charge-receiving member 10 escapes through ventilation holes 13 provided in charging member 1, so as to suppress any lifting of the charging member 1. The fins 15 receive the pressure force of the air passing through ventilation holes 13 and press the charging member 1 toward the charge-receiving member 10. Thus, the lifting of the charging member 1 is suppressed all the more. Furthermore, the charging member 1 is adhered to the charge-receiving member 10 by the electrostatic attraction of semiconductor member 14. Therefore, even greater uniformity is maintained in the discharge gap between the various electrodes 12 and the charge-receiving member 10, regardless of the surface irregularities and surface waviness of the charge-receiving member 10 and the airflow generated by the rotation of said charge-receiving member 10. As a result, an even greater suppression of discharge synchronicity lags is provided. The electrodes 12 are also more difficult to break. The charging device of FIG. 24 may use the electrical circuit shown in FIG. 21.

The fins 15 must have a certain degree of hardness to achieve the previously described function. The fins 15 and ventilation holes 13 should be formed so as to allow the flexible insulation member 11 bend or flex. In this instance, however, the fins 15 are also flexible and may be bent by the pressure of the airflow, leading to a concern that the fins may not be adequately effective in pressing the flexible insulation member 11 against the charge-receiving member 10. To alleviate such a concern, a separate member can be glued only in the vicinity of the ventilation holes 13, so as to increase the thickness only near the ventilation holes 13. Of course, the fins 15 may be formed of other materials and may be mounted on the flexible insulation member 11.

The combination of fins 15 and ventilation holes 13 may also be used in the charging members shown in FIGS. 2–17, and 19–23.

Figure 25:
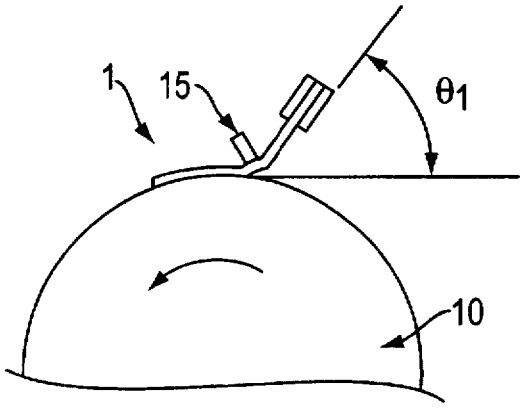
FIG. 25 illustrates the contact state of the charge-receiving member of the charging device of FIG. 24.

FIG. 25 shows the state of contact between the charging member 1 and the charge-receiving member 10 of charging device G shown in FIG. 24. When charging member 1 is electrostatically adhered to the rotating charge-receiving member 10, charging member 1 is bent at a bending angle of about θ1 (degrees). When the surface of charge-receiving member 10 is moving, the charging member 1 is slightly oscillating in the direction of the surface movement of the charge-receiving member 10 by the balance of the forces adhering and maintaining charging member 1 and the friction force between charging member 1 and charge-receiving member 10. The bent portion of charging member 1 is subject to fatigue due to this oscillation, and may lead to a breaking of the flexible electrodes 12 on the charging member 1. The time it takes for such electrode breakage occurs differs depending on the material, thinness and shape of the flexible electrodes 12. Further, when the bending angle of θ1 (degrees) exceeds 45°, the service life of the component is less than ½ of when the bending angle is less than 45°. The service life is increased when the bending angle θ1 is less than 30°.

Figure 26A:
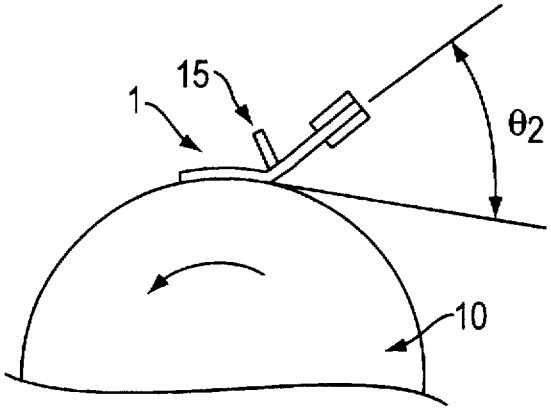
FIGS. 26(A) and 26(B) show another example of the contact state of the charge-receiving member of the charging device of FIG. 24.
Figure 26B:
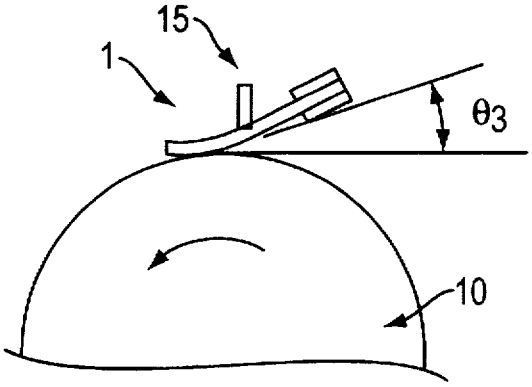

FIGS. 26(A) and 26(B) show another example of the state of contact between the charging member 1 and the charge-receiving member 10 of the charging device G shown in FIG. 24. In FIG. 26(A), charging member 1 is electrostatically adhered to the charge-receiving member 10. At this time, charging member 1 is bent at a bending angle θ2 (degrees). FIG. 26(B) shows the condition when charging member 1 is not electrostatically adhered to the charge-receiving member 10. Without electrostatic adherence, a charging member 1 is bent at a bending angle θ3 (degrees), which is less than the bending angle θ2 (degrees) of the charging member 1 in FIG. 24(A).

Normally, a charging member 1 is electrostatically adhered to a charge-receiving member 10 during printing. However, voltage is not applied to the semiconductor member when the power is OFF or during non printing time. Hence, there is no electrostatic attraction between the charging member 1 and the charge-receiving member 10 when the power is OFF. Going from an adhered state to a non-adhered state repeatedly causes fatigue due to the bending of a portion of charging member 1, and can lead to a breakage of the flexible electrodes 12 of said charging member 1. The time it takes for the electrodes to break varies depending on the material, thinness and shape of the flexible electrode. Further, when the absolute value of |θ2–θ3| (degrees) exceeds 30°, the service life of the component is less than ½ when the absolute value of |θ2–θ3| (degrees) is less than 30°. Furthermore, the service life of the component is increased when the absolute value of |θ2–θ3| (degrees) is less than 20°.

Figure 27A:
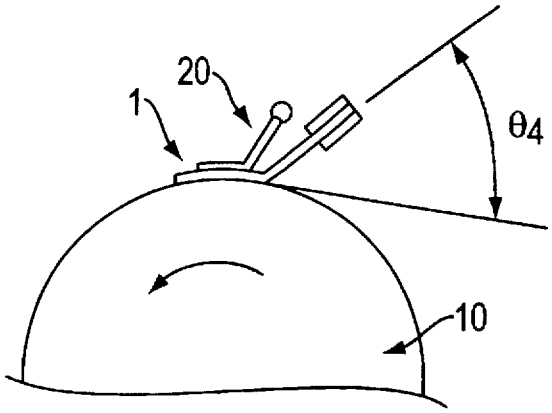
FIGS. 27(A) and 27(B) are side views of another example of the charging device of the present invention.
Figure 27B:
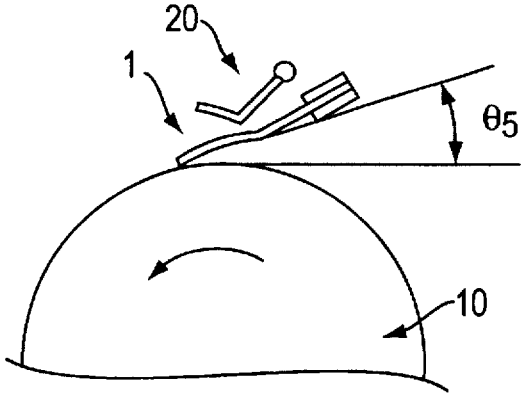

FIGS. 27(A) and 27(B) show another example of a charging device of the present invention. The charging member 1 in this charging device is provided with an array of flexible wire electrodes 12 on a flexible insulation member 11, and a semiconductive member 14 on the charge-receiving member side of insulation member 11. FIG. 27(A) shows the conditions when charging member 1 electrostatically adheres to the charge-receiving member 10 and is pressed by a pressure member 20, wherein the charging member 1 is bent at a bending angle θ4 (degrees). FIG. 27(B) shows the conditions when charging member 1 is not electrostatically adhered to charge-receiving member 10, and is not pressed by pressure member 20; at this time, charging member 1 is bent at a bending angle θ5 (degrees). Normally, the charging member 1 is pressed against the charge-receiving member 10 by pressure member 20 during printing, and pressure member 20 is released so as to not press charging member 1 against the charge-receiving member 10 during non-printing or when the power source is OFF. Repetition of the pressure state and the non-pressure state can lead to the occurrence of fatigue at the bending portion of charging member 1 and can cause a breakage of the flexible wire electrodes 12 of the charging member 1. The length of time for such electrode breakage to occur can vary depending on the material, thinness and shape of the flexible electrode. Moreover, when the absolute value of |θ4–θ5| (degrees) exceeds 30°, the service life of the component is less than ½ that of when the absolute value of |θ4–θ5| (degrees) is less than 30°. Furthermore, the service life of the component can be increased if the absolute value of |θ4–θ5| (degrees) is less than 20°.

When a contact relationship is used that increases component service life such as in the charging device of the present invention, the position of the contact of the charging member 1 relative to charge-receiving member 10 is stable, and print irregularities are eliminated to a greater degree.

Furthermore, breakage of the electrodes are reduced.

Figure 28:
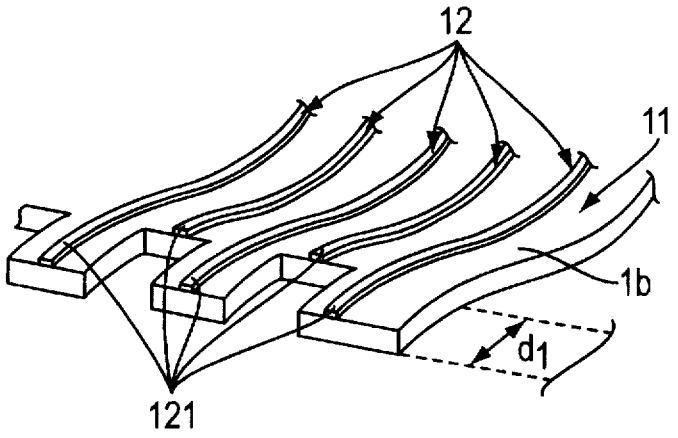
FIG. 28 is a partial perspective view of a charging member in another example of a charging device of the present invention.

FIG. 28 shows another example of a charging member of a charging device of the present invention. Charging member 1 is provided with flexible wire electrodes 12 on a flexible insulation member 11. The downstream edge 1*b* of the flexible insulation member 11 has a comb tooth shape. As such, the discharge tips 121 of adjacent electrodes 12 are shifted and recessed from one another in the direction of surface movement of the charge-receiving member.

As a result, in the charging device illustrated in FIG. 28, leakage between electrodes is suppressed even under conditions of high humidity, and even when electrode density is increased in a direction transverse to the direction of surface movement of the charge-receiving member. Thus, the charging device is capable of producing high resolution images without printing errors.

In the case of the charging member illustrated in FIG. 28, the distance d1 separating adjacent electrode tips 121 in the direction of surface movement of the charge-receiving member and the speed of movement of the charge-receiving member determine the print delay time t1 (seconds) from the upstream side comb tooth shaped electrode tips 121*a* to the downstream side electrode tips 121*b*. Further, the print signal for the downstream side electrode must be delayed by time t1. In this embodiment, the print signals supplied to the electrodes 12 of the upstream side (e.g., electrode tip 121*a*) and downstream side (e.g., electrode tip 121*b*) do not overlap because the print pulse cycle is set to be other than an integer multiple of time t1 and 1/(the integer multiple). Accordingly, an advantageous reduction in the peak voltage supplied to charging member 1 is possible. It is preferable that the print signals be delayed only ½ the print pulse cycle to reduce the peak voltage.

Figure 29:
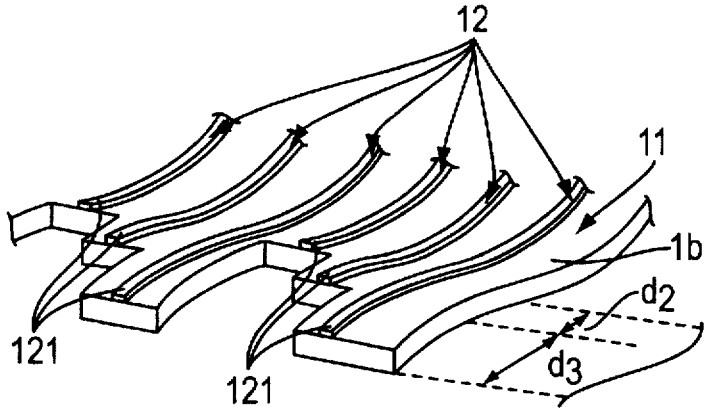
FIG. 29 is a partial perspective view of a charging member in another example of a charging device of the present invention.

FIG. 29 illustrates another example of a charging member in a charging device of the present invention. Charging member 1 is provided with flexible electrodes 12 on a flexible insulation member 11. Similar to the embodiment of FIG. 28, the downstream edge 1*b* of the flexible insulation member 11 has a comb tooth shape. Specifically, the downstream edge 1*b* has a three-stage comb tooth shape. In this embodiment, the distance d2, d3 separating the tips 121 of adjacent electrodes 12 is farther than in non-comb tooth arrangements.

As with the embodiment of FIG. 28, the charging device illustrated in FIG. 29 suppresses leakage between electrodes 12 even under conditions of high humidity, and allows for an increase in electrode density in a direction transverse of the surface movement of the charge-receiving member.

As can be understood from this example, if the distance separating the discharge tips 121 of adjacent electrodes 12 is increased, the edges of electrodes 12 and flexible insulation member 11 can be finished in a variety of configurations.

As in the embodiment illustrated in FIG. 28, the distance separating electrode tips 121*a*, 121*b* and 121*c* of adjacent electrodes 12 in the direction of surface movement of the charge-receiving member and the speed of movement of the charge-receiving member determine the print delay times t2 and t3 (seconds) from the upstream side comb tooth shaped electrode tips 121 to the downstream side electrode tips 121. Also, the print signals for the downstream side electrodes must be delayed by times t2 and t3. The print signals supplied to the electrodes 12 of the upstream side and downstream side do not overlap because the print pulse cycle is set to be other than an integer multiple of time t2 and t3 and 1/(the integer multiple). Thus, an advantageous reduction in the peak voltage supplied to charging member 1 is possible. It is preferred that the print signals are delayed only ⅓ the print pulse cycle to reduce the peak voltage.

Figure 30A:
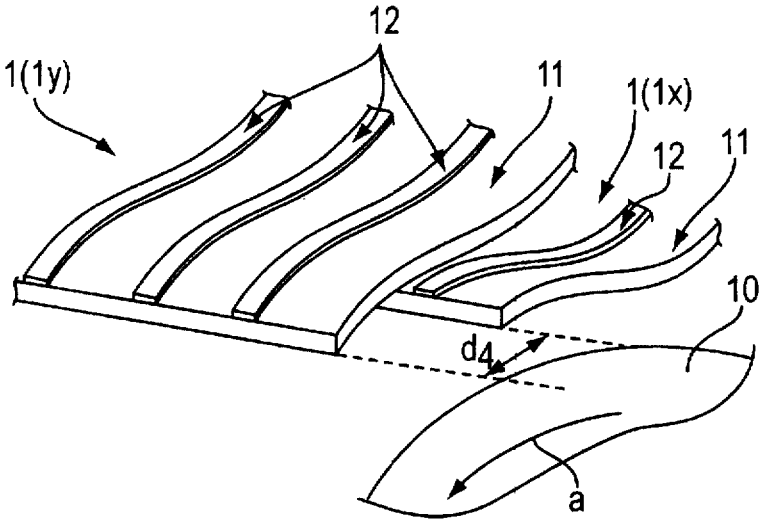
FIG. 30(A) is a partial perspective view of two charging members in yet another example of a charging device of the present invention.

FIG. 30(A) illustrates another example of a charging member of a charging device of the present invention. In this embodiment, a plurality (two in the embodiment of FIG. 30(A)) of charging members 1 are provided. The plurality of charging members 1 are provided with flexible electrodes 12 on flexible insulation members 11, and are arranged so as to be separated by a distance in the direction d4 of surface movement of the charge-receiving member 10. The electrodes 12 on the upstream charging member 1 (1X) and the electrodes 12 on the downstream charging member 1 (1Y) are arranged so as to avoid any mutual overlapping in the direction of surface movement of the charge-receiving member. The electrodes 12 of the downstream charging member 1Y are arranged so as to correspond to intermediate positions of each electrode 12 of upstream charging member 1X which are arrayed in the perpendicular direction relative to the direction of surface movement of the charge-receiving member 10. Thus, a total print density double that possible by the separate flexible electrodes 12 on either the upstream and downstream charging members can be realized.

In the embodiments illustrated in FIG. 30(A)–30(D), the distance d4 separating the discharge tips of the upstream charging member 1X and the discharge tips of the downstream charging member 1Y is expressed as: surface speed of charge-receiving member (mm/sec)×t4 (sec).

Similar to the charging member of FIG. 28, the print signals for the downstream electrodes 1Y must be delayed time t4 (sec). In this case, the print signals supplied to the electrodes 12 of the upstream charging member and downstream charging member do not overlap because the print pulse cycle is set outside an integer multiple of time t4 and 1/(the integer multiple), thereby allowing a reduction in the peak voltage supplied to charging member 1. It is preferable that the print signals are delayed only ½ the print pulse cycle to reduce the peak voltage.

Although two charging members are used in the example above, the print density can be increased by using a plurality of charging members comprising three or more.

Figure 30B:
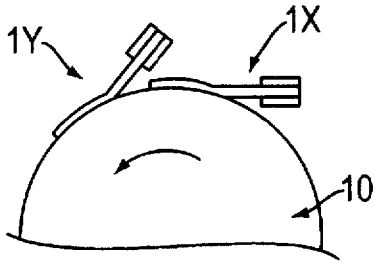
FIG. 30(B) is a side view of an example of the mounted state of said charging member.
Figure 30C:
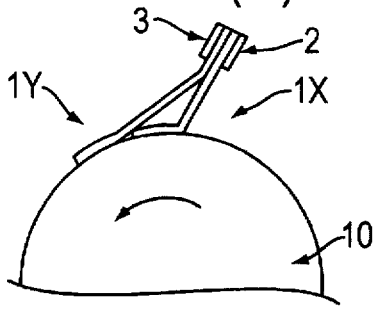
FIG. 30(C) is a side view showing another example of the mounting state of said charging member.
Figure 30C:
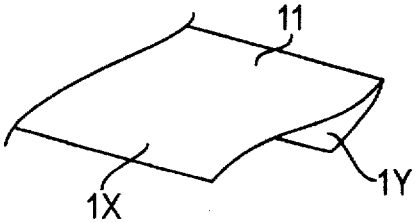

As shown in FIG. 30(B), the two charging members 1X and 1Y can be arranged independently and, as shown in FIG. 30(C), these two charging members 1X, 1Y can be grouped as a unit by support member 2 and holding member 3. Alternatively, as shown in FIG. 30(D), a single flexible insulation member 11 can be used, to which is provided with an upstream electrode 12 and downstream electrode 12, with the flexible insulation member 11 being bent so as to form an upstream charging member 1Y and downstream charging member 1X.

In the case of separately supported charging members 1X, 1Y as shown in FIG. 30(B), the positional accuracy of the charging members 1X, 1Y relative to the direction perpendicular to the direction of surface movement of the charge-receiving member is important. As such, care must be taken when mounting each charging member.

When supported as shown in FIG. 30(C), and formed as shown in FIG. 30(D), the positional accuracy of each charging member relative to the direction perpendicular to the direction of surface movement of the charge-receiving member is determined the moment the charging members are gripped. Thus, properly positioning the charging member is relatively easy.

Looking at the plurality of charging members 1 used in this type of charging device, the relative positions of adjacent electrode tips 121 in a direction transverse to the direction of surface movement of the charge-receiving member are mutually dislocated in the direction of surface movement of the charge-receiving member. Accordingly, stable charging can be accomplished even under conditions of high humidity by suppressing leaks between electrode tips by presetting the distance to adequately suppress leaks between electrodes.

Furthermore, the aforesaid distance is provided in the direction of movement of the surface of the charge-receiving member to suppress leaks between electrode tips, such that the density of electrodes 12 can be increased in a direction transverse to the movement direction. The charging members 1 shown in FIGS. 28–30 can utilize one or more components among the previously described ventilation holes 13, pressure fin 15, and semiconductive member 14 and/or electret member.

Figure 31:
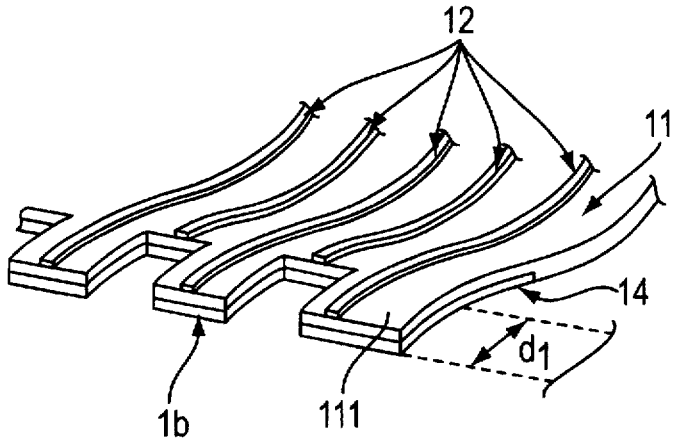
FIG. 31 is a partial perspective view of a modification of the charging member of FIG. 28.
Figure 32:
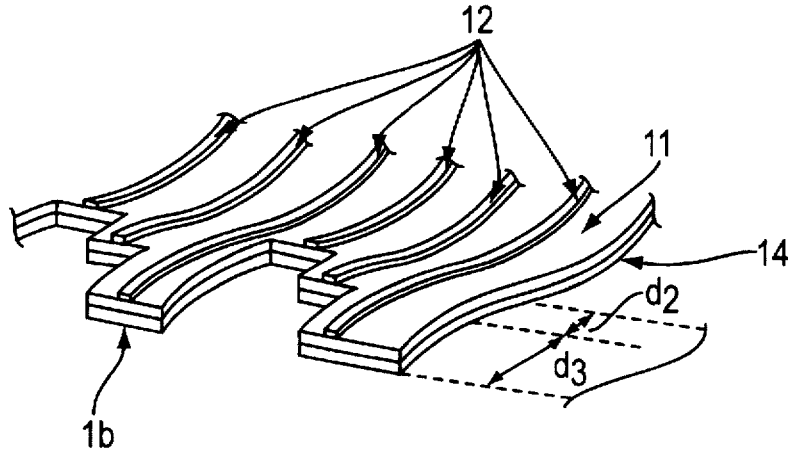
FIG. 32 is a partial perspective view of a modification of the charging member of FIG. 29.

FIG. 31 shows an example of a charging member 1 provided with a semiconductive member 14 on tip 111 of electrode tip 121 on the charge-receiving member side of flexible insulation member 11, and FIG. 32 shows a charging member 1 provided with a semiconductive member 14 on all surfaces of the flexible insulation member 11. In the charge members illustrated in FIGS. 28–30, warping readily occurs on the edge portions because the charging member tip 1*b* is formed in a comb tooth shape. However, the application of semiconductive member 14 provides electrostatic adhesion of charging member 1 to charge-receiving member 10, such that a uniform discharge distance is maintained.

Of course, it should be understood that a wide range of changes and modifications can be made to the preferred embodiment described above. It is therefore intended that the foregoing detailed description be understood that it is the following claims, including all equivalents, which are intended to define the scope of this invention.

What is claimed is:

1. A charging device for charging a charge-receiving member relatively moving in a predetermined direction relating to said charging device, comprising:

a flexible sheet charging member having a first surface for facing a charge-receiving member and a second surface opposing said first surface, said first surface having a first portion and a second portion, said first portion for contacting said charge-receiving member; and at least one ventilation hole passing between said first surface and said second surface in said second portion of said flexible sheet charging member, whereby airflow can escape through said at least one ventilation hole to suppress any lifting of said flexible sheet charging member due to the airflow.

2. A charging device as claimed in claim 1, further comprising:

a plurality of electrodes provided on said second surface, said electrodes being aligned in a direction orthogonal to said moving direction; and a driver power source connected to said electrodes for applying a voltage signal to said electrodes.

3. A charging device as claimed in claim 2, wherein said driver power source applies a voltage signal to said electrodes corresponding to an image to be printed.

4. A charging device as claimed in claim 2, wherein said electrodes are covered with a material that has an electrical resistance higher than that of said electrodes.

5. A charging device as claimed in claim 2, wherein said electrodes have a uniform width and are separated from each other.

6. A charging device as claimed in claim 5, wherein said electrodes are separated from each other by a distance within a range of about 30 μm to about 100 μm.

7. A charging device as claimed in claim 1, further comprising:

a semiconductive material covering at least said first portion of said first surface.

8. A charging device as claimed in claim 7, further comprising:

a voltage source connected to said semiconductive material for applying a voltage to said semiconductive material.

9. A charging device as claimed in claim 8, wherein said voltage applied to said semiconductive material is insufficiently high to charge the charge-receiving member.

10. A charging device as claimed in claim 1, further comprising:

an electret material covering at least said first portion of said first surface.

11. A charging device as claimed in claim 1, further comprising:

at least one fin provided on said second surface adjacent said at least one ventilation hole, said fin for pressing said flexible sheet charging member toward said charge-receiving member in accordance with force induced by air passing though said ventilation hole.

12. A charging device for charging a charge-receiving member relatively moving in a predetermined direction relating to said charging device, comprising:

a flexible sheet charging member having a first surface for facing a charge-receiving member and a second surface opposing said first surface, said first surface having a first portion and a second portion, said first portion for contacting said charge-receiving member; and electret material covering at least a portion of said first surface.

13. A charging device as claimed in claim 12, further comprising:

a plurality of electrodes provided on said second surface, said electrodes being aligned in a direction orthogonal to said moving direction; and a drive power source connected to said electrodes for applying a voltage signal to said electrodes.

14. A charging device as claimed in claim 13, wherein said drive power source applies a voltage signal to said electrodes corresponding to an image to be printed.

15. A charging device as claimed in claim 12, wherein said electret material includes perfluoroalkoxy.

16. A charging device as claimed in claim 12, wherein said electret material includes fluoroethylenepropylene.

17. A printing apparatus having a charge-receiving member and a charging member, wherein said charge-receiving member relatively moves in a predetermined direction relating to said charging member, said charging member comprising:

a flexible sheet charging member having a first surface for facing a charge-receiving member and a second surface opposing said first surface, said first surface having a first portion and a second portion, said first portion for contacting said charge-receiving member;

at least one ventilation hole passing between said first surface and said second surface in said second portion of said flexible sheet charging member, whereby airflow can escape through said at least one ventilation hole to suppress any lifting of said flexible sheet charging member due to the airflow; and a material covering at least a portion of said first surface of said flexible sheet charging member for causing said charging member to adhere to the charge-receiving member.

18. A charging device as claimed in claim 17, further comprising:

at least one fin provided on said second surface adjacent said at least one ventilation hole, said fin for pressing said flexible sheet charging member toward said charge-receiving member in accordance with force induced by air passing though said ventilation hole.

19. A charging device as claimed in claim 17, wherein said material covering said first surface includes electret material.

20. A charging device as claimed in claim 17, wherein said material covering said first surface includes semiconductive material connectable to a voltage source, whereby when a voltage is applied to said semiconductive material, the semiconductive material adheres to the charge-receiving member.

21. A charging device for charging a surface of a charge-receiving member, wherein said member moves relative to said charging device in a moving direction, said charging device comprising:

a flexible sheet having a first surface with a downstream side with respect to the moving direction for contacting said charge-receiving member, and with an upstream side with respect to the moving direction for facing said charge-receiving members, said first surface being terminated at a downstream side edge, said sheet further having a second surface that extends from the downstream side edge in an extending direction substantially orthogonal to said surface of said charge-receiving member;

a plurality of electrodes each of which terminates at a portion of said second surface of said downstream.

22. A charging device as claimed in claim 21, wherein said electrodes are aligned in a direction orthogonal to the moving direction.

23. A charging device as claimed in claim 22, further comprising:

a driver which is connected to said electrodes to apply voltage to said electrodes in accordance with image data.

24. A charging device as claimed in claim 21, wherein said sheet has a third surface opposing to said first surface of which downstream side being in contact with said charge-receiving member, and wherein said electrodes are provided on said third surface.

25. A charging device for charging a surface of a charge-receiving member, wherein said member moves relative to said charging device in a moving direction, said charging device comprising:

a flexible sheet having a surface with a downstream side with respect to the moving direction for contacting said charge-receiving member, and with an upstream side with respect to the moving direction for facing said charge-receiving member;

wherein a length of said surface of said downstream side of said sheet contacts a surface of said charge-receiving member for charging the surface of said charge-receiving member;

a plurality of electrodes each of which terminates at an edge of said downstream side of said sheet;

wherein said sheet has a second surface opposing to said surface of which downstream side is in contact with said charge-receiving member, and wherein said electrodes are provided on said second surface.

26. A charging device for charging a surface of a charge-receiving member, wherein said member moves relative to said charging device in a moving direction, said charging device comprising:

a flexible sheet having a surface with a downstream side with respect to the moving direction for contacting said charge-receiving member, and with an upstream side with respect to the moving direction for facing said charge-receiving member;

wherein a length of said surface of said downstream side of said sheet contacts a surface of said charge-receiving member for charging the surface of said charge-receiving member;

a plurality of electrodes each of which terminates at an edge of said downstream side of said sheet; and wherein length being 3 mm or more.

27. A charging device for charging a surface of a charge-receiving member which relatively moves in a moving direction, said charging device comprising:

at least one electrode which is connectable to a voltage source, said voltage source being for applying a voltage having a predetermined polarity to said electrode;

a first member, which has an electrical potential of which polarity is same as the predetermined polarity, for contacting with the charge-receiving member; and a second member which is disposed between said electrode and said first member, said second member being made of an electrically insulative material.

28. A charging device as claimed in claim 27, wherein said first member is contacted with said charge-receiving member with having a length with respect to the moving direction in order to charge a surface of said charge-receiving member.

29. A charging device as claimed in claim 28, wherein said length is 3 mm or more.

30. A method for adhering a charging member to a charge-receiving member, said charging member including a flexible sheet charging member having a first surface for facing a charge-receiving member and a second surface opposing said first surface, said first surface having a first portion and a second portion, said first portion for contacting said charge-receiving member, semiconductive material covering at least a portion of said first surface, and dielectric material covering said charge-receiving member, said method comprising the steps of:

a. moving said charge-receiving member in a predetermined direction relative to said charging member;

b. discharging said dielectric material; and c. applying a voltage to said semiconductive material, whereby an electrostatic attraction force is generated between said charging member and said charge-receiving member causing said charging member to adhere to said charge-receiving member and to maintain a uniform distance from said charge-charge-receiving member, wherein said voltage applied to said semiconductive materials is insufficiently high to charge the charge-receiving member.

31. A method for adhering a charging member to a charge-receiving member, said charging member including a flexible sheet charging member having a first surface for facing a charge-receiving member and a second surface opposing said first surface, said first surface having a first portion and a second portion, said first portion for contacting said charge-receiving member, semiconductive material covering at least a portion of said first surface, dielectric material covering said charge-receiving member, and a plurality of electrodes provided on said second surface, said electrodes being aligned in a direction orthogonal to said moving direction and being applied a voltage signal, said method comprising the steps of:

a. moving said charge-receiving member in a predetermined direction relative to said charging member;

b. discharging said dielectric material; and c. applying a voltage to said semiconductive material, whereby an electrostatic attraction force is generated between said charging member and said charge-receiving member causing said charging member to adhere to said charge-receiving member and to maintain a uniform distance from said charge-receiving member, wherein said voltage applied to said semiconductive materials is insufficiently high to charge the charge-receiving member.

32. A method for adhering a charging member to a charge-receiving member, said charging member including a flexible sheet charging member having a first surface for facing a charge-receiving member and a second surface opposing said first surface, said first surface having a first portion and a second portion, said first portion for contacting said charge-receiving member, semiconductive material covering at least a portion of said first surface, dielectric material covering said charge-receiving member, and a plurality of electrodes provided on said second surface, said electrodes being aligned in a direction orthogonal to said moving direction and being applied a voltage signal, said method comprising the steps of:

a. moving said charge-receiving member in a predetermined direction relative to said charging member;

b. discharging said dielectric material; and c. applying a voltage to said semiconductive material, whereby an electrostatic attraction force is generated between said charging member and said charge-receiving member causing said charging member to adhere to said charge-receiving member and to maintain a uniform distance from said charge-receiving member, wherein said voltage applied to said semiconductive materials is insufficiently high to charge the charge-receiving member, and wherein said voltage signal applied to said electrodes corresponding to an image to be printed.

33. A charging device for charging a charge-receiving member relatively moving in a predetermined direction relating to said charging device, comprising:

a flexible sheet charging member having a first surface for facing a charge-receiving member and a second surface opposing said first surface, said first surface having a first portion and a second portion, said first portion for contacting said charge-receiving member;

semiconductive material connectable to a voltage source covering at least a portion of said first surface; and a plurality of electrodes provided on said second surface, said electrodes being aligned in a direction orthogonal to said moving direction and being applied a voltage signal.

34. A charging device as claimed in claim 33, wherein said voltage signal applied to said electrodes corresponding to an image to be printed.

35. A charging device for charging a charge-receiving member relatively moving in a predetermined direction relating to said charging device, comprising:

a flexible sheet charging member having a first surface for facing a charge-receiving member and a second surface opposing said first surface, said first surface having a first portion and a second portion, said first portion for contacting said charge-receiving member;

semiconductive material connectable to a voltage source covering at least a portion of said first surface; and a voltage source connected to said semiconductive material for applying a voltage to said semiconductive material, whereby when a voltage is applied to said semiconductive material, the semiconductive material adheres to the charge-receiving member; and wherein said voltage is insufficiently high to charge the charge-receiving member.

36. A charging device for charging a charge-receiving member relatively moving in a predetermined direction relating to said charging device, comprising:

a flexible sheet charging member having a first surface for facing a charge-receiving member and a second surface opposing said first surface, said first surface having a first portion and a second portion, said first portion for contacting said charge-receiving member;

semiconductive material connectable to a voltage source covering at least a portion of said first surface;

a plurality of electrodes provided on said second surface, said electrodes being aligned in a direction orthogonal to said moving direction; and a drive power source connected to said electrodes for applying a voltage signal to said electrodes.

37. A charging device as claimed in claim 36, wherein said drive power source applies a voltage signal to said electrodes corresponding to an image to be printed.

38. A charging device for charging a surface of a charge-receiving member which relatively moves in a moving direction, said charging device comprising:

a flexible sheet having a surface of which downstream side with respect to the moving direction being for contracting said charge-receiving member, and of which upstream side with respect to the moving direction being for facing to said charge-receiving member; and a plurality of electrodes each of which terminates an edge of downstream side of said sheet, wherein said edge of said sheet has a plurality of recesses and a plurality of protrudings, each of said recesses and protrudings being corresponding to the terminations of electrodes, respectively.

39. A charging device for charging a surface of a charge-receiving member which relatively moves in a moving direction, said charging device comprising:

a flexible sheet having a surface of which downstream side with respect to the moving direction being for contacting said charge-receiving member, and of which upstream side with respect to the moving direction being for facing to said charge-receiving member; and a plurality of electrodes each of which terminates and edge of downstream side of said sheet, wherein said downstream side of said sheet has a length with respect to the moving direction, said length being 3 mm or more.

40. A charging device for charging a surface of a charge-receiving member which relatively moves in a moving direction, said charging device comprising:

at least one electrode which is connectable to a voltage source, said voltage source being for applying a voltage having a predetermined polarity to said electrode;

a first member, which has an electrical potential of which polarity is same as the predetermined polarity, for contacting with the charging-receiving member; and a second member which is disposed between said electrode and said first member, said second member being made of an electrically insulative material, wherein said first member is made of semiconductive material and connectable to a second voltage source which applies a voltage having a polarity same as said predetermined polarity.

41. A charging device as claimed in claim 40, wherein said second voltage source applies a voltage which is insufficiently high to charge said charge-receiving member.

42. A charging device for charging a surface of a charge-receiving member which relative moves in a moving direction, said charging device comprising:

at least one electrode which is connectable to a voltage source, said voltage source being for applying a voltage having a predetermined polarity to said electrode;

a first member, which has an electrical potential of which polarity is same as the predetermined polarity, for contacting with the charge-receiving member; and a second member which is disposed between said electrode and said first member, said second member being made of an electrically insulative material, wherein said first member is made of semiconductive material and connectable to a second voltage source which applies a voltage having a polarity same as said predetermined polarity.

43. A charging device for charging a surface of a charge-receiving member which relatively moves in a moving direction, said charging device comprising:

at least one electrode which is connectable to a voltage source, said voltage source being for applying a voltage having a predetermined polarity to said electrode;

a first member, which has an electrical potential of which polarity is same as the predetermined polarity, for contacting with the charge-receiving member; and a second member which is disposed between said electrode and said first member, said second member being made of an electrically insulative material, wherein said voltage source applies voltage to said electrodes in accordance with an image data.

* * * * *